US011719066B1

(12) United States Patent
Castrillon et al.

(10) Patent No.: US 11,719,066 B1
(45) Date of Patent: Aug. 8, 2023

(54) OIL WELL ROTATING CEMENT HEAD

(71) Applicants: Rene Castrillon, Arden, NC (US); Oscar Ramirez, Bogota (CO)

(72) Inventors: Rene Castrillon, Arden, NC (US); Oscar Ramirez, Bogota (CO)

( * ) Notice: Subject to any disclaimer, the term of this patent is extended or adjusted under 35 U.S.C. 154(b) by 0 days.

(21) Appl. No.: 17/483,420

(22) Filed: Sep. 23, 2021

Related U.S. Application Data

(60) Provisional application No. 63/082,223, filed on Sep. 23, 2020.

(51) Int. Cl.
*E21B 33/05* (2006.01)
*E21B 17/05* (2006.01)

(52) U.S. Cl.
CPC ..... *E21B 33/05* (2013.01); *E21B 17/05* (2013.01)

(58) Field of Classification Search
CPC ..... E21B 33/05; E21B 17/05
See application file for complete search history.

(56) References Cited

U.S. PATENT DOCUMENTS

| | | | |
|---|---|---|---|
| 3,951,208 | A | 4/1976 | Delano |
| 4,427,065 | A | 1/1984 | Watson |
| 4,736,807 | A | 4/1988 | Davis |
| 4,782,894 | A | 11/1988 | LaFleur |
| 5,293,933 | A | 3/1994 | Brisco |
| 5,755,296 | A | 5/1998 | Richardson et al. |
| 5,833,002 | A | 11/1998 | Holcombe |
| 5,890,537 | A | 4/1999 | Lavaure et al. |
| 5,950,724 | A | 9/1999 | Giebeier |
| 6,776,228 | B2 | 8/2004 | Pedersen et al. |
| 7,857,052 | B2 | 12/2010 | Giroux et al. |
| 8,302,698 | B2 | 11/2012 | Giem |
| 8,381,808 | B2 | 2/2013 | Rogers et al. |
| 8,910,707 | B2 | 12/2014 | Klimack et al. |
| 9,249,646 | B2 | 2/2016 | Hannegan et al. |
| 9,500,060 | B2 | 11/2016 | Robichaux et al. |
| 9,534,469 | B2 | 1/2017 | Hunt |
| 9,605,505 | B2 | 3/2017 | Robichaux et al. |
| 9,611,722 | B2 | 4/2017 | Hem et al. |
| 9,957,773 | B1 | 5/2018 | Barbee, Jr. |
| 10,053,954 | B2 | 8/2018 | Stautzenberger et al. |
| 10,094,197 | B2 | 10/2018 | Ward et al. |
| 10,119,355 | B2 | 11/2018 | Rogozinski et al. |
| 2003/0132002 | A1* | 7/2003 | Giebeler ..... E21B 21/02 166/365 |

(Continued)

*Primary Examiner* — Taras P Bemko
(74) *Attorney, Agent, or Firm* — The Patent Professor; John Rizvi

(57) ABSTRACT

An oil well rotating cement head includes a swivel assembly and a plug launcher assembly. The swivel assembly includes a swivel shaft and a collar-shaped, outer swivel subassembly. The swivel shaft has an internal through bore and windows extending through the swivel shaft, and extends through the outer swivel subassembly. The swivel shaft and outer swivel subassembly enclose an inner annular gap in fluid communication with the windows of the swivel shaft. A material inlet formed in the outer swivel subassembly is in fluid communication with the inner annular gap. The plug launcher assembly is affixed to the swivel shaft and releasably holds one or more oil well cementing plugs. The plug launcher assembly provides fluid communication from the internal through bore of the swivel shaft to a bottom end of the plug launcher assembly.

24 Claims, 15 Drawing Sheets

(56) References Cited

U.S. PATENT DOCUMENTS

| | | | | |
|---|---|---|---|---|
| 2010/0101792 | A1* | 4/2010 | Rogers | E21B 23/00 166/70 |
| 2010/0200222 | A1* | 8/2010 | Robichaux | E21B 33/05 166/70 |
| 2011/0048710 | A1* | 3/2011 | Robichaux | E21B 17/05 166/70 |
| 2011/0280104 | A1 | 11/2011 | McClung, III | |
| 2013/0327532 | A1 | 12/2013 | Ring et al. | |
| 2014/0151044 | A1* | 6/2014 | Robichaux | E21B 33/05 166/70 |
| 2016/0102523 | A1 | 4/2016 | Sponchia et al. | |

* cited by examiner

OIL WELL ROTATING CEMENT HEAD

CROSS-REFERENCE TO RELATED APPLICATIONS

This application claims the benefit of U.S. Provisional Patent Application No. 63/082,223, filed on Sep. 23, 2020, which is incorporated herein by reference in its entirety.

FIELD OF THE INVENTION

The present invention relates generally oil well cementing devices and, more particularly, to an oil well rotating cement head having a combined, cement insertion swivel assembly and a connected, plug launcher assembly.

BACKGROUND OF THE INVENTION

Oil wells are typically drilled into the Earth and thereafter provided with a consecutive arrangement of casings (commonly referred to as "casing string") lining the internal walls of the oil well, with an annular space or gap being left between the casing string and the oil well walls. The purpose of the casing string is to block rocks, debris, or other undesired substances from entering the oil well. After the casing string is deposited into the oil well, the oil well is then sealed to prevent escape or leak of valuable gas or oil outside of the oil well casing string, and thereby avoid losses both in the gas/oil energy and in time and money. This sealing process is known as cementing, and essentially consists in inserting cement into the annular gap available between the casing string and the oil well wall, to prevent the flow of oil/gas up outside of the casing string.

A typical cementing process more specifically includes pumping a mud or mud slurry down the inside of the casing string, around the bottom (distal) end of the distalmost casing, and into the annular gap between the casing string and the oil well wall. Continued pumping of the mud or mud slurry causes the mud or mud slurry to flow upward along the annular area or gap around the outside of the casing string to "sweep" debris from inside the casing string and from the gap and therefore clean, and prepare, the gap for receipt of the cement. Various other materials, such as, but not limited to, oils, nitrogen-filled slurries, etc., may follow the mud to further prepare the area for the cement. The swept debris and other materials (if any) are typically protected outward through the proximal end of the annular gap at the top end of the oil well, after having passed downward through the casing string and upward through the annular gap thereby cleaning the casing string and annular gap.

Once the casing string and annular gap have been cleaned, and before injecting the cement in order to seal the annular gap around the casing string, a "wiper" plug is dropped from outside the oil well and down the inside of the casing string to wipe away any remaining oil or other material which may remain inside the casing string and potentially contaminate the cement and prevent it from setting properly. In some cases, more than one wiper plug may be required, such as if the oil well is initially filled with a relatively high amount of debris. Once the inside of the casing strings has been wiped clean by the one or more plugs, the cement or cement slurry is injected downwards into the casing string. The injected cement or cement slurry travels downward through the casing string and around the bottom or distal end of the casing sting, and progresses into the annular gap between the casing string and the oil well wall, traveling upward along the annular gap and eventually filling the annular gap.

Simultaneously to injecting the cement or cement slurry, it is often necessary to both rotate the casing string and vertically translate or oscillate (reciprocate) the casing string to allow the cement or cement slurry to flow freely and evenly and to set properly, to obtain a solid and homogeneous positive seal about the casing string. In order to rotate and axially reciprocate the casing string during the cementing process, a cementing head configured to move jointly with the casing string is often connected to a top end of the casing string, and a drill head or device is connected to the cementing head to drive the head to rotate and longitudinally oscillate, thereby rotating and longitudinally oscillating the casing string. Some cementing heads further allow the injection of cement or cement slurry into and through the cement head and, therefrom, into the casing string.

Once it is determined that the required amount of cement has been injected into the oil well and the annular gap is adequately filled, cement feeding is stopped, and a final or "closing" plug is typically launched into the oil well in order to seal the bottom of the distal or bottom end of the casing string and prevent cement, while still not completely cured, from flowing back into the casing string from the annular gap.

Current cementing devices are available to send cement down the casing string but are difficult to use in that they need to be assembled from the bottom up requiring the workers to upwardly support the components of the devices during assembly. Further, it is often difficult with these devices in getting the cement into the rotating and oscillating casing string, and often, the cost of manufacture of these devices is high due to the number and complexity of parts involved. Additionally, in order to send wiper plugs down the casing string, the rig has to be stopped for a substantial amount of time while a plug launching device is connected to the casing string, a plug sent down the casing string and the plug launching device removed from the casing string before the rotation and oscillation of the casing string can continue.

Accordingly, there is need for a solution to at least one of the aforementioned problems. For instance, there is an established need for cementing heads that can inject cement into the casing string while the casing string is both rotating and oscillating, and are yet cost effective and/or requiring fewer and/or less complex parts. Alternatively or additionally, it is desired that the cementing head facilitates rapid and efficient plug launching during the cementing process.

SUMMARY OF THE INVENTION

The present invention is directed to an oil well cementing head having a combined material insertion swivel assembly rotatably mounted on a shaft and a plug launcher assembly, releasably retaining one or more cementing plugs, affixed to the shaft. The shaft is connectable to a drive shaft of an oil rig and the plug launcher assembly is connectable to the oil well casing string. The shaft may include an internal through bore and windows extending through the shaft and open to the through bore. The swivel assembly may include a collar-shaped, outer swivel subassembly having an inlet in fluid communication with an annular ring or gap provided on an inner surface of the collar-shaped, outer swivel subassembly. The annular gap may be aligned with the windows of the shaft for the passage of material therethrough. The plug launcher assembly may include an outer shell and an inner sleeve and defines a longitudinal channel therebetween. The longitudinal channel may be in fluid communication with the through bore of the shaft. The plug may be releasably retained within the inner sleeve by a release mechanism. The plug launcher assembly may additionally include an indicator to give a visual indication when a plug has been successfully released from the plug launcher assembly. The indicator may be manually-resettable.

In a first implementation of the invention, an oil well cementing head for insertion of material and one or more plugs into a casing string of an oil well is provided, the oil well cementing head comprising:

a swivel assembly comprising a swivel shaft and a collar-shaped, outer swivel subassembly, wherein the swivel shaft comprises an internal through bore and windows extending through the swivel shaft, wherein the swivel shaft extends through the outer swivel subassembly, and the swivel shaft and outer swivel subassembly enclose an inner annular gap in fluid communication with the windows of the swivel shaft, and further wherein the outer swivel subassembly comprises a material inlet in fluid communication with the inner annular gap; and a plug launcher assembly affixed to the swivel shaft and releasably retaining at least one oil well cementing plug, the plug launcher assembly providing fluid communication from the internal through bore of the swivel shaft to a bottom end of the plug launcher assembly.

In a second aspect, plug, the plug launcher assembly may include one or more plug modules. Each plug module may include an outer shell, an inner sleeve and longitudinal channels extending between the outer shell and the inner sleeve. The longitudinal channels may be in fluid communication with the through bore of the swivel shaft. The plug module may further include a release mechanism for releasing the plug out of the plug module. The longitudinal channels are configured to convey the material received from the swivel shaft past a plug located inside the inner sleeve.

In another aspect, the cementing plug launcher may further include a top cap for connection to the swivel shaft, a bottom connector for connection to an oil well casing string. The one or more plug modules may be mounted between the top cap and bottom connector.

In another aspect, the swivel shaft may include a ledge for supporting the swivel assembly such that the swivel assembly is able to oscillate in an up and down motion with the swivel shaft.

In another aspect, the swivel assembly may include an anchor point to secure the swivel assembly against rotation with the swivel shaft.

In yet another aspect, the plug launcher assembly may include a resettable, pivotable indicator having an outer segment and an inner segment such that a plug released down through the plug launcher assembly trips the inner segment to raise the outer segment.

In another implementation of the invention, an oil well cementing head for insertion of material and one or more plugs into a casing string of an oil well may include a swivel assembly mountable between a drive head and a casing string. The swivel assembly may include a swivel shaft formed along a longitudinal direction, the swivel shaft configured to be rotated about a central longitudinal axis thereof and longitudinally reciprocated by the drive head. The swivel shaft may include an internal bore extending longitudinally along the swivel shaft and one or more windows formed through the swivel shaft in fluid communication with the internal bore. The swivel assembly may further include an outer swivel subassembly carried by the swivel shaft and jointly movable with the swivel shaft in the longitudinal direction. The outer swivel subassembly may be arranged radially outward of and around the swivel shaft such that the swivel shaft extends through the outer swivel subassembly. The outer swivel subassembly may include a rotatable subassembly including a material inlet. The rotatable subassembly and swivel shaft may be rotatable relative to one another about the central longitudinal axis such that the rotatable subassembly main remain rotationally fixed while the swivel shaft rotates relative to the central longitudinal axis. The outer swivel subassembly and swivel shaft may enclose an annular gap therebetween. The annular gap may face the rotatable subassembly and material inlet and may be in fluid communication with the material inlet and the windows of the swivel shaft in all rotational positions of the swivel shaft relative to the rotatable subassembly.

In a second aspect, the outer swivel subassembly may further include a non-rotatable subassembly, which may be arranged at opposite longitudinal ends of the rotatable subassembly. The non-rotatable subassembly may be fixedly attached to the swivel shaft for joint rotational and longitudinal movement with the swivel shaft. The non-rotatable subassembly may block longitudinal movement of the rotatable subassembly relative to the swivel shaft.

In another aspect, the non-rotatable and rotatable subassemblies may be mountable by successive stacking on the swivel shaft from a top end of the swivel shaft towards a bottom end of the swivel shaft.

In another aspect, the oil well cementing head may further include an anchor affixed to the rotatable subassembly of the outer swivel subassembly. The anchor may provide a connection point to secure the rotatable subassembly against rotation with the swivel shaft.

In another aspect, the anchor may extend radially outward of the rotatable subassembly.

In yet another aspect, the oil well cementing head may further include a plug launcher assembly affixed to and jointly rotatable and longitudinally movable with the swivel shaft of the swivel assembly. The plug launcher assembly may releasably contain at least one oil well cementing plug and may provide fluid communication from the internal through bore of the swivel shaft to a bottom end of the plug launcher assembly.

In another aspect, the at least one oil well cementing plug may include two or more plugs, and the plug launcher assembly may include two or more plug modules. Each plug module may releasably house a respective plug of the two or more plugs. Each plug module may be selectively mountable to the swivel shaft alone or in series with one or more remaining plug modules of the two or more plug modules to transfer a rotational and longitudinal movement of the swivel shaft towards a bottom end of the plug launcher assembly.

In another aspect, the oil well cementing head may further include one or more alignment wedges disconnectably connectable between adjacent plug modules of the two or more plug modules and configured to prevent relative rotation between the adjacent plug modules.

In another aspect, the plug launcher assembly may include a top cap configured to jointly rotate and longitudinally move with a bottom end of the swivel shaft and a bottom cap configured to jointly rotate and longitudinally move with an oil well casing string. The two or more plug modules may be each selectively connectable alone or in series with one or more remaining plug modules of the two or more plug modules between the top and bottom caps to transfer rotational and longitudinal movement of the top cap to the bottom cap.

In yet another aspect, the two or more plug modules may be connectable in series with the one or more remaining plug modules in a longitudinally interchangeable manner.

In another aspect, the oil well cementing head may further include one or more alignment wedges disconnectably connectable between the top cap and an adjacent plug module of the two or more plug modules and configured to prevent relative rotation between the top cap and the adjacent plug module.

In another aspect, the oil well cementing head may further include one or more alignment wedges disconnectably connectable between the bottom cap and an adjacent plug module of the two or more plug modules and configured to prevent relative rotation between the bottom cap and the adjacent plug module.

In another aspect, at least one of the two or more plug modules may include a launching wheel arranged outside the plug module and a wheel shaft connected to the launching wheel. The wheel shaft may extend into the plug module and may be movable by operating the launching wheel from an initial position in which the wheel shaft supports the respective plug inside the plug module to an extracted position in which the wheel shaft does not support the respective plug and the respective plug may be free to fall through the plug module.

In yet another aspect, each plug module of the two or more plug modules may include a longitudinal through bore defined by an inner surface of the plug module. One or more channels may be formed radially outward in the inner surface. Each plug module may further include an inner sleeve arranged inside the through bore and sealing against the inner surface to enclose the one or more channels. The respective plug may be received inside the inner sleeve. The two or more plug modules may be mountable in series such that the one or more channels of each plug module are in fluid communication with the one or more channels of the remaining plug modules.

In another aspect, the one or more channels of a topmost plug module of the two or more plug modules may be in fluid communication with the internal bore of the swivel shaft.

In another aspect, the one or more channels of a bottommost plug module of the two or more plug modules may be in fluid communication with a bottom end of the plug launcher subassembly.

In another aspect, the plug launcher assembly may include a pivotable indicator having jointly-pivotable outer and inner segments. The indicator may be configured to pivotably adopt an inactive position in which the inner segment extends into the plug launcher assembly to interfere with a downward passing therethrough of a plug and the outer segment is arranged in a lowered position, and an active position in which the inner segment is pivoted downward allowing a plug to pass and the outer segment is pivoted to a visible, raised position.

In yet another aspect, the pivotable indicator may be pivotable from the active position to the inactive position by manually pivoting the outer segment.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an improved oil well cementing head for use in an oil well cementing process.

Figure 1:
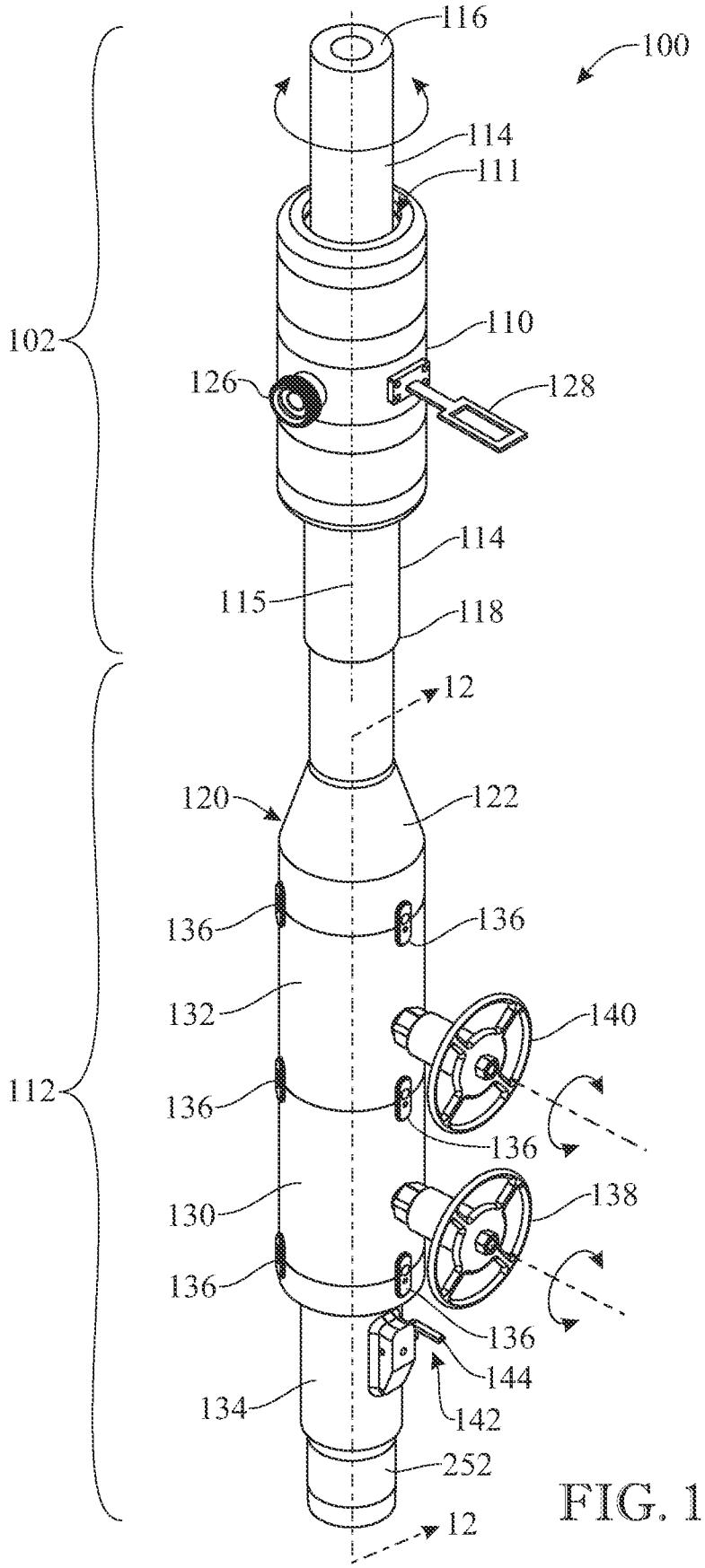
FIG. 1 presents a top, front isometric view of an oil well cementing head in accordance with an illustrative embodiment of the present invention, the oil well cementing head including a swivel assembly and a plug launcher assembly.
Figure 2:
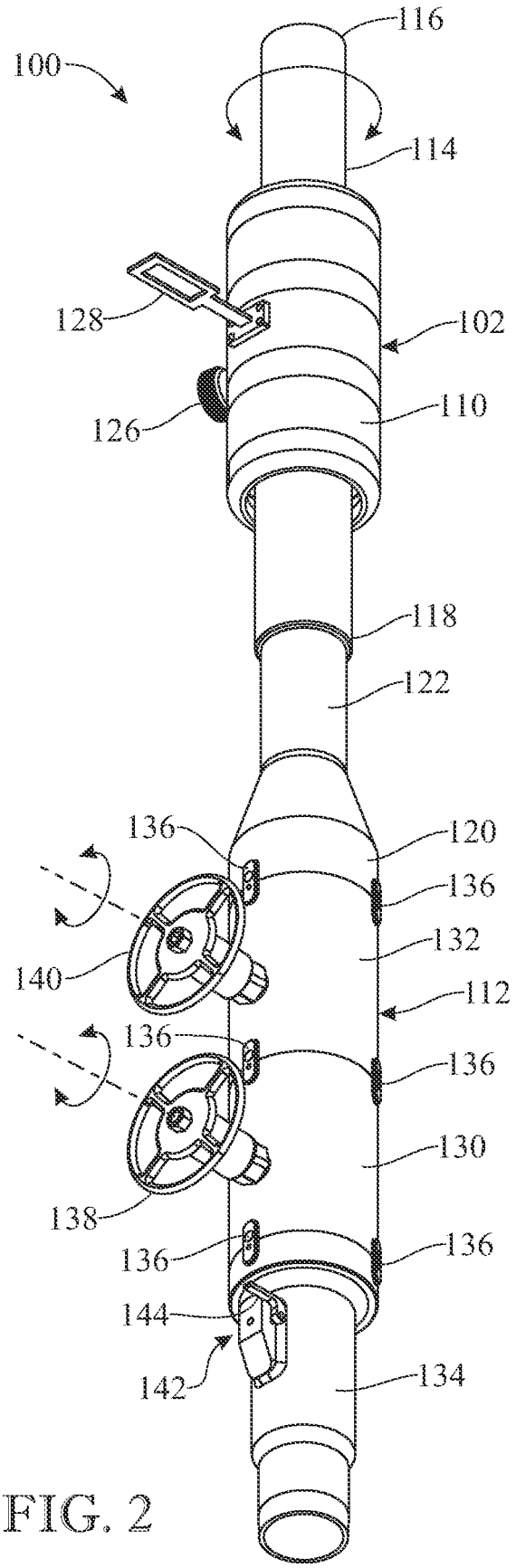
FIG. 2 presents a bottom, front isometric view of the oil well cementing head illustrated in FIG. 1.

Referring initially to FIGS. 1 and 2, an oil well cementing head for use in an oil well cementing process, hereinafter oil well cementing head 100, is illustrated in accordance with an exemplary embodiment of the present invention. As shown, the oil well cementing head 100 generally includes a swivel assembly 102 and a plug launcher assembly 112. The swivel assembly 102 comprises an outer swivel subassembly 110 and a swivel shaft 114. The outer swivel subassembly 110 is configured as a collar having a central longitudinal cavity or space 111 extending longitudinally through the outer swivel subassembly 110. In turn, the swivel shaft 114 extends through the outer swivel subassembly 110, and more specifically, along the central longitudinal space 111 of the outer swivel subassembly 110, and is affixed to the plug launcher assembly 112. A top end 116 of the swivel shaft 114 is configured to attach to a drill head (not shown) in order for the drill head to drive the swivel shaft 114 as will be described hereinafter. In turn, a bottom end 118 of the swivel shaft 114 is connected to the plug launcher assembly 112. In some embodiments, such as the present embodiment, the bottom end 118 of the swivel shaft 114 may be connected, more specifically, to an outer shell 120 of the plug launcher assembly 112. For example, as shown herein, the bottom end 118 of the swivel shaft 114 may be connected to a top cap 122 of the outer shell 120 of the plug launcher assembly 112. In some embodiments, the connection between the bottom end 118 of the swivel shaft 114 and the plug launcher assembly 112 may include a threading and/or a welding, for instance and without limitation.

The plug launcher assembly 112 is attached to an oil well casing string (not shown) extending down though the oil well. In turn, the swivel shaft 114 of the swivel assembly 102 is attached to a drill head, as mentioned heretofore, and to the plug launcher assembly 112. During operation of the oil well cementing head 100, the drill head rotates the swivel shaft 114 about a central longitudinal axis 115 of the swivel shaft 114 and reciprocates or oscillates the swivel shaft 114 in a longitudinal or axial (vertical) motion, i.e. in a direction parallel to the central longitudinal axis 115, to prevent cement (not shown) from solidifying as it is poured or inserted into the oil well casing string and helps to distribute the cement evenly through the casing string and into the annular space down through the well and surrounding the casing string.

The swivel assembly 102 of the present disclosure is further configured to receive cement from outside the oil well cementing head 100 and direct the cement into the oil well casing string while the oil well cementing head 100 is being driven to rotate and reciprocate by the drive head, as will be described in greater detail hereinafter. As shown in FIG. 1, the collar-shaped, outer swivel subassembly 110, surrounding the swivel shaft 114, includes a cement inlet 126 for receipt of cement and passage of the cement into the swivel shaft 114 of the oil well cementing head 100. As will described in more detail hereinafter, the collar-shaped, outer swivel subassembly 110 reciprocates axially with the movement of the swivel shaft 114 but does not rotate with the rotation of the swivel shaft 114. This facilitates attaching a cement feed to the oil well cementing head 100 and injecting cement into the oil well cementing head 100 and thus into the casing string; for example, a relatively simple cement feed in the form of a hose or other transfer device may be attached to the cement inlet 126 without the cement feed having to be prepared or configured to withstand rotation. During operation of the oil well cementing head 100, an external structure may be connected to the outer swivel subassembly 110 to maintain the outer swivel subassembly 110 in a fixed or relatively fixed angular position while the swivel shaft 114 is rotating within and relative to the outer swivel subassembly 110; for example, a connection point or anchor 128 may be affixed to or provided on the collar-shaped, outer swivel subassembly 110 and may facilitate the attachment thereto of an external structure such as, but not limited to, a cable and pulley assembly (not shown) which may hold or retain the collar-shaped, outer swivel subassembly 110, not allowing the outer swivel subassembly 110 to rotate, and yet providing sufficient freedom of movement for the collar-shaped, outer swivel subassembly 110 to longitudinally oscillate together with the swivel shaft 114.

The plug launcher assembly 112, in turn, may be formed as a modular assembly to facilitate selecting the number of cementing plugs, i.e. preparing the oil well cementing head 100 to launch a selected number of cementing plugs, depending on the particular need. For example, the plug launcher assembly 112 shown herein generally includes a first plug module 130 and a second plug module 132, arranged between the aforementioned top cap 122 and a bottom connector 134. The bottom connector 134 is disconnectably, non-rotationally and non-axially-movably connectable to the oil well casing string such that, when connected, rotation and longitudinal oscillation of the bottom connector 134 is transferred to the casing string. The top cap 122, the second plug module 132, the first plug module 130 and the bottom connector 134 are threaded together and configured to jointly rotate and oscillate. It should be noted that a different number of plug modules including one, three or more plug modules, may be provided in other embodiments or implementations of the invention, depending on the number of plugs, described below, needed to execute the cementing process. In some embodiments, as shown in FIG. 1, a plurality of alignment wedges 136 may be provided to ensure that the top cap 122, the selected number of plug modules (e.g., second plug module 132 and first plug module 130) and the bottom connector 134 are mounted to one another in perfect alignment, as described in more detail hereinbelow.

Figure 9:
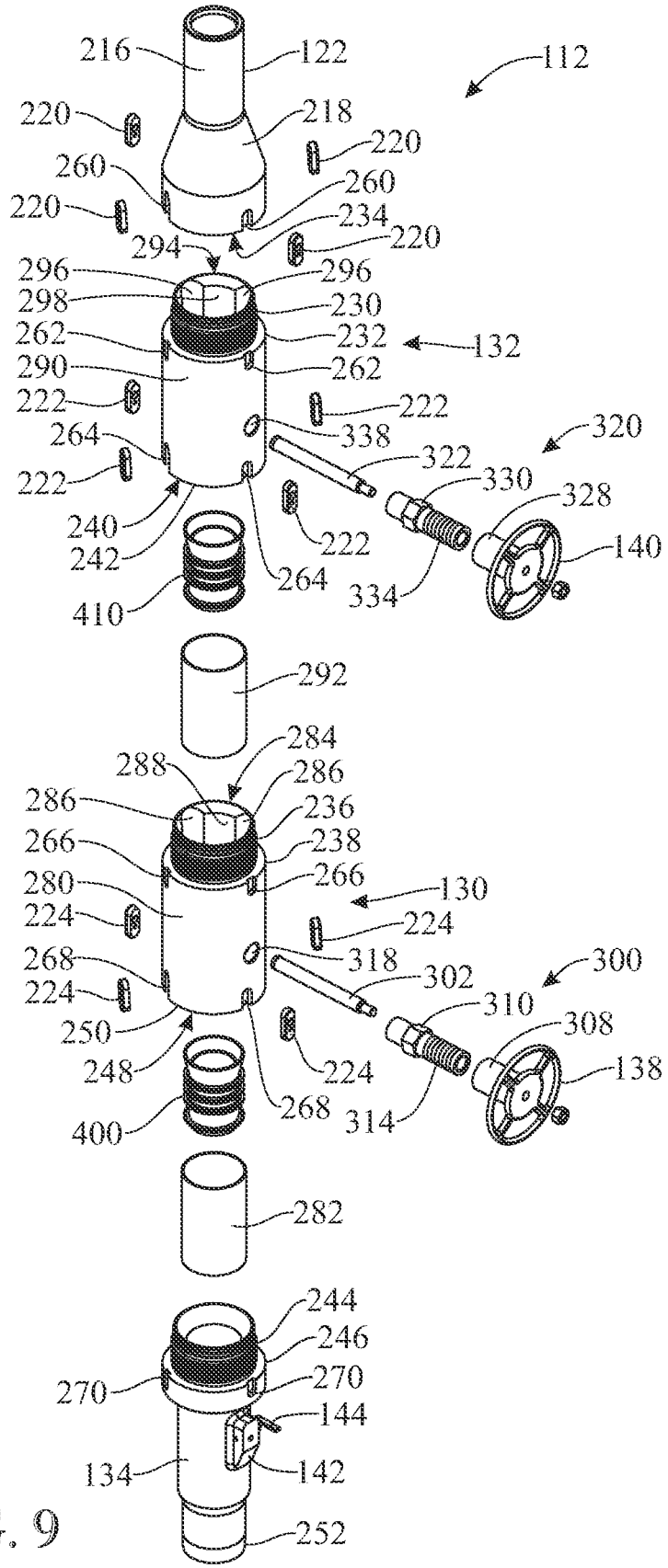
FIG. 9 presents an exploded, top front isometric view of the plug launcher assembly of FIG. 8.
Figure 12:
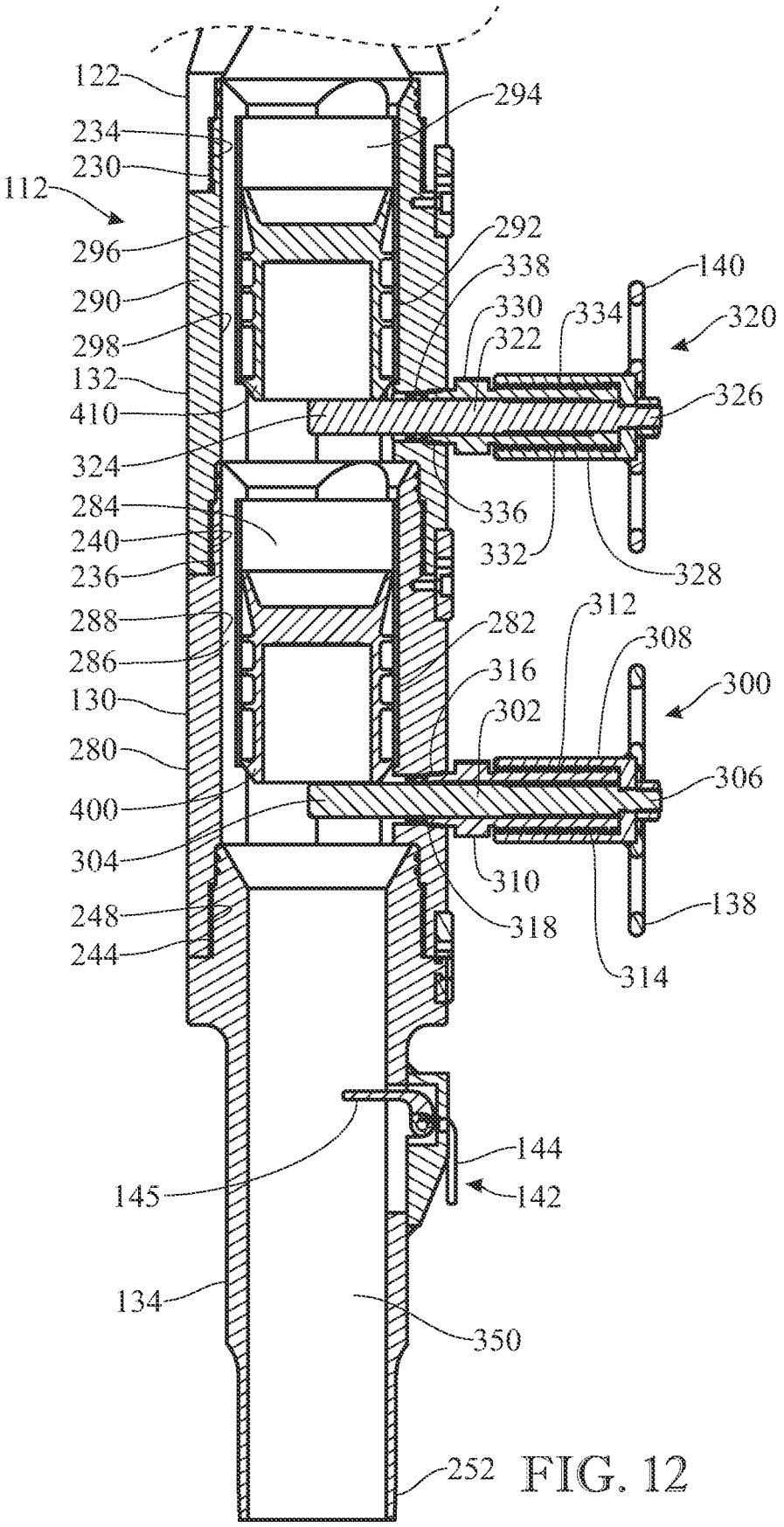
FIG. 12 presents a cross-sectional, side elevation view of the plug launcher assembly of FIGS. 1 and 8, the cross section taken along section plane 12-12 indicated in FIG. 1.

Each of the plug modules includes or contains at least one plug for use during the oil well cementing process. For example, in the present embodiment, as shown in FIG. 9, the first plug module 130 contains a first plug 400 and the second plug module 132 contains a second plug 410. With reference again to FIG. 1, the first plug module 130 includes a user-operable, first launching wheel 138 for releasing or launching the first plug 400 down the casing string and the second plug module 132 includes a second launching wheel 140 for releasing or launching the second plug 410 down the casing string. The plug launcher assembly 112 further includes a resettable indicator 142 mounted to the bottom connector 134. The indicator 142 may include an L-shaped or otherwise angled body comprising an outer segment 144 and an inner segment 145 (FIG. 12) pivotable jointly with one another and arranged, for instance, forming an angle of 90 degrees with one another. As best shown in FIG. 12, the indicator 142 is pivotably attached to the bottom connector 134, with the inner segment 145 extending into the bottom connector 134 the outer segment 144 extending outward of the bottom connector 134. The outer segment 144 provides a visual indicator or "flag" for giving a positive and visible indication that a plug has successfully been launched out of the respective module, through the bottom connector 134 and down the casing string to wipe an inside bore of the casing string clean to receive the cement and avoid contamination of the cement from prior mud or oils, to seal the bottom of the oil well after injecting the cement, or for other applicable needs.

Figure 3:
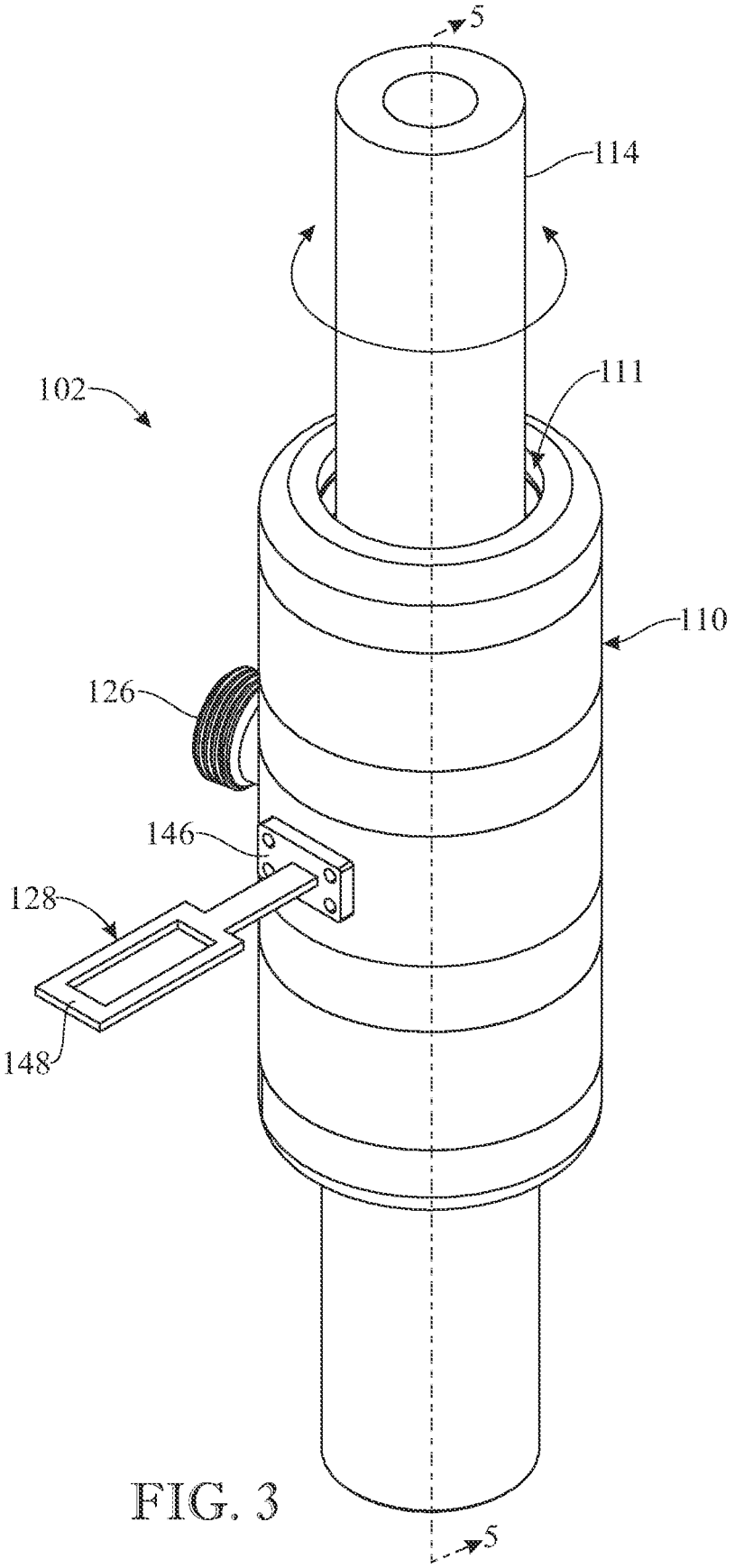
FIG. 3 presents an enlarged top, front isometric view of the swivel assembly of the oil well cementing head of FIG. 1.
Figure 4:
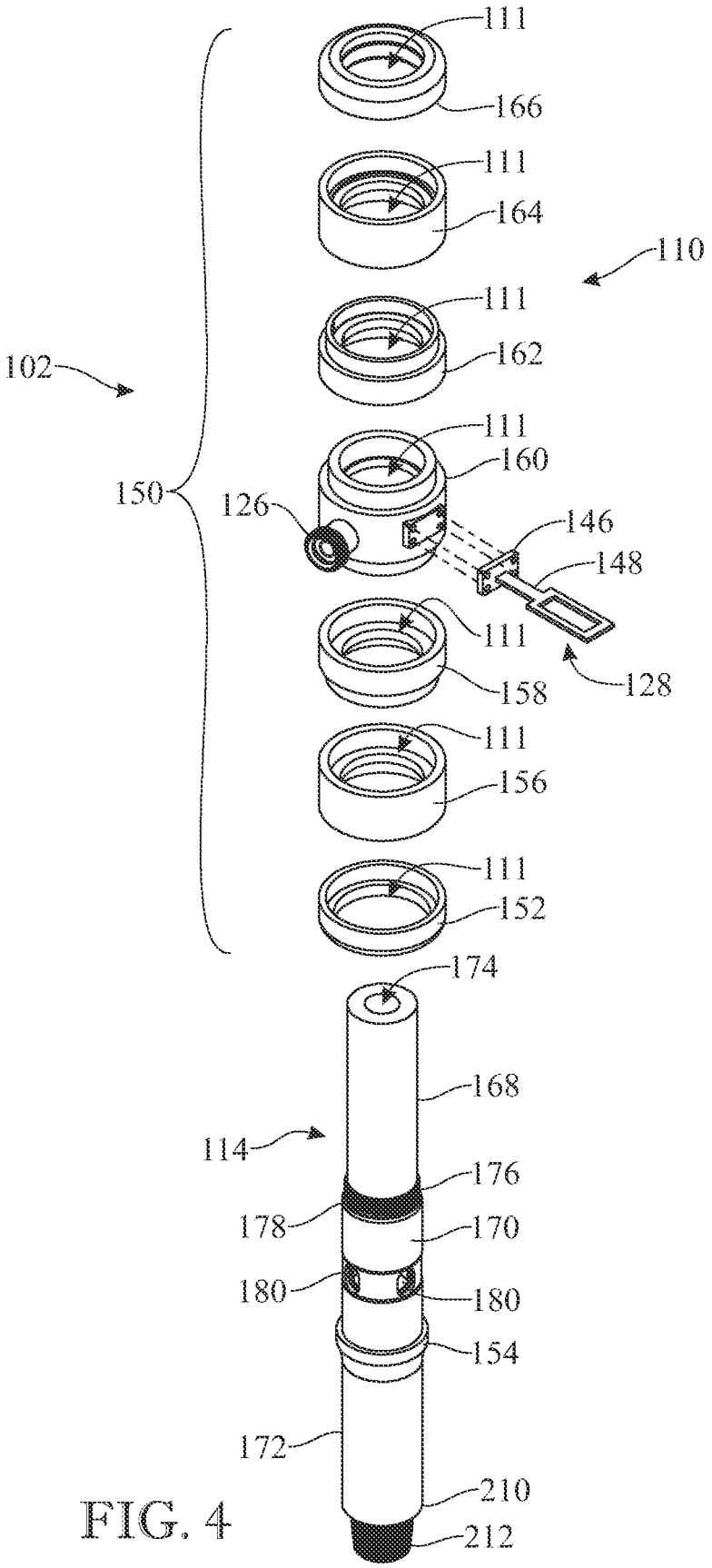
FIG. 4 presents an exploded, top front isometric view of the swivel assembly of FIG. 3.

Turning now to FIGS. 3-7, the swivel assembly 102 will be described in more detail. With reference initially to FIGS. 3 and 4, and as noted hereinabove, the swivel shaft 114 is rotatably received within the outer swivel subassembly 110. The anchor 128 may be provided to facilitate the connection thereto of an external structure or device, such as a cable (not shown) anchored to a stationary part of the oil well, to prevent the outer swivel subassembly 110 from rotating with the swivel shaft 114. The anchor 128 may include a base 146 affixed to the collar-shaped, outer swivel subassembly 110, such as by bolts, rivets, or the like, and an anchor connecting arm or connector 148 extending from the base 146 for receipt of the securing cable or other external device or structure.

Figure 5:
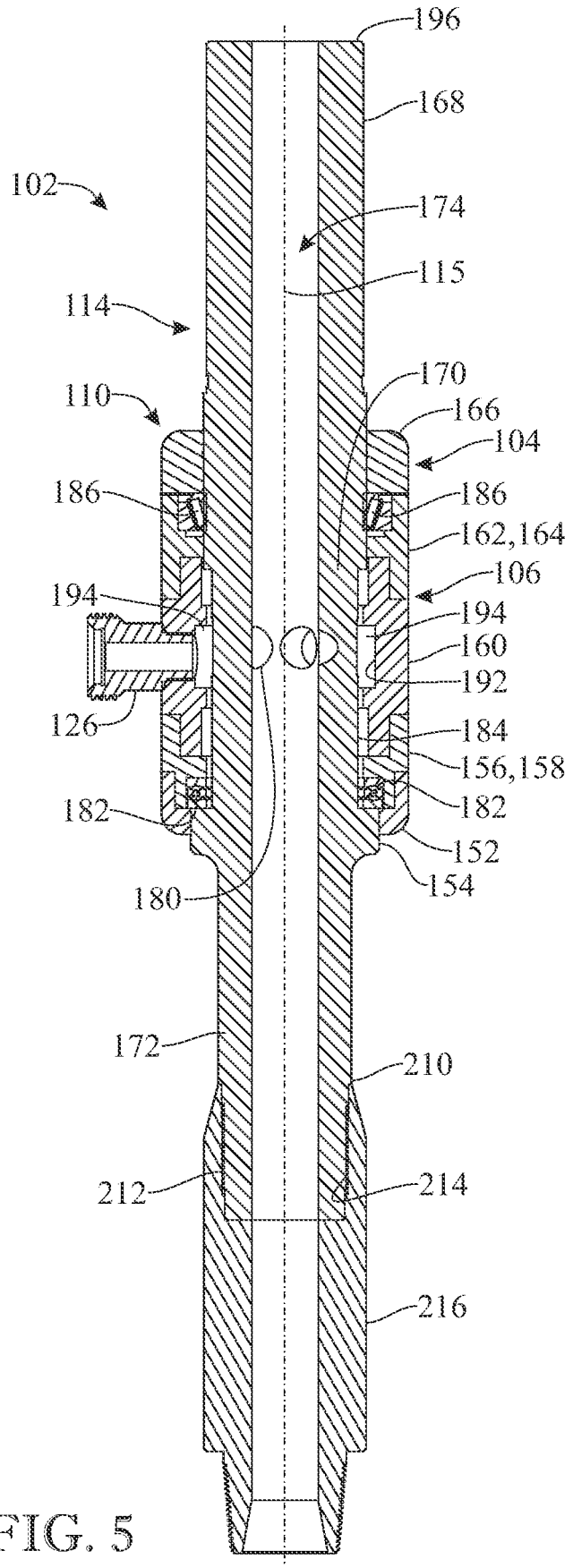
FIG. 5 presents a cross-sectional side elevation view of the swivel assembly of FIG. 3, the cross section taken along section plane 5-5 indicated in FIG. 3.

With reference to FIGS. 4 and 5, the present collar-shaped, outer swivel subassembly 110 is formed from a series of annular parts or nesting collars 150. The collar-shaped, outer swivel subassembly 110 may be assembled from the bottom up, by fitting the series of nesting collars 150 vertically downward onto the swivel shaft 114, as assisted by gravity, and with gravity further contributing to seal the different components of the outer swivel subassembly 110 against one another to help prevent cement leaking out of the outer swivel subassembly 110. The series of nesting collars 150 of the present embodiment includes a lower end cap 152 which is initially inserted over and down on the swivel shaft 114 and which surrounds an annular ledge 154 formed about the swivel shaft 114. The series of nesting collars 150 additionally includes one or more bearing-retaining collars (for example, a bottom bearing-retaining collar 156 and a top bearing-retaining collar 158) which are positioned over the end cap 152 in nested fashion. A cement-receiving central collar 160, comprising the cement inlet 126, is assembled to the top bearing-retaining collar 158 in nested fashion. The central collar 160 receives the cement from the cement inlet 126 and directs the cement into the swivel shaft 114 in a manner described in more detail hereinbelow. Above the cement-receiving central collar 160 are mounted one or more sealing collars (e.g., a bottom sealing collar 162 and a top sealing collar 164) which may seal about the swivel shaft 114. Above and mounted to the top sealing collar 164 is an upper end cap 166, configured to secure a set of seals (described hereinbelow) within the collar-shaped, outer swivel subassembly 110, with the seals positioned and mounted within the one or more sealing collars 164 and 166 in nested fashion. The disclosed collar-shaped, outer swivel subassembly 110 of the swivel assembly 102 may be easily assembled over the swivel shaft 114 by fitting each element over the swivel shaft 114 and allowing said each element to descend, as facilitated by gravity, onto the element arranged beneath it and previously fitted onto the swivel shaft 114. In one non-limiting example, the central collar 160 may be formed from a bronze material. Alternatively or additionally, the bearing-retaining collars 156 and 158 and the sealing collars 162 and 164 may be formed from a PTFE material, for instance and without limitation.

With continued reference to FIG. 4, the swivel shaft 114 depicted herein includes an upper shaft section 168, a central shaft section 170 and a lower shaft section 172. The upper shaft section 168, the central shaft section 170 and the lower shaft section 172 may be formed separately or integrally, and together define a central through bore 174 for the passage of the cement from the cement inlet 126 to the plug launcher assembly 112 (FIG. 1). External threads 176 may be provided at a top end 178 of the central collar 160 for purposes that will be described hereinafter. The central shaft section 170 of the swivel shaft 114 includes a series of transverse openings or windows 180 extending radially through the swivel shaft 114 for passage of cement into the through bore 174 of the swivel shaft 114.

Figure 6:
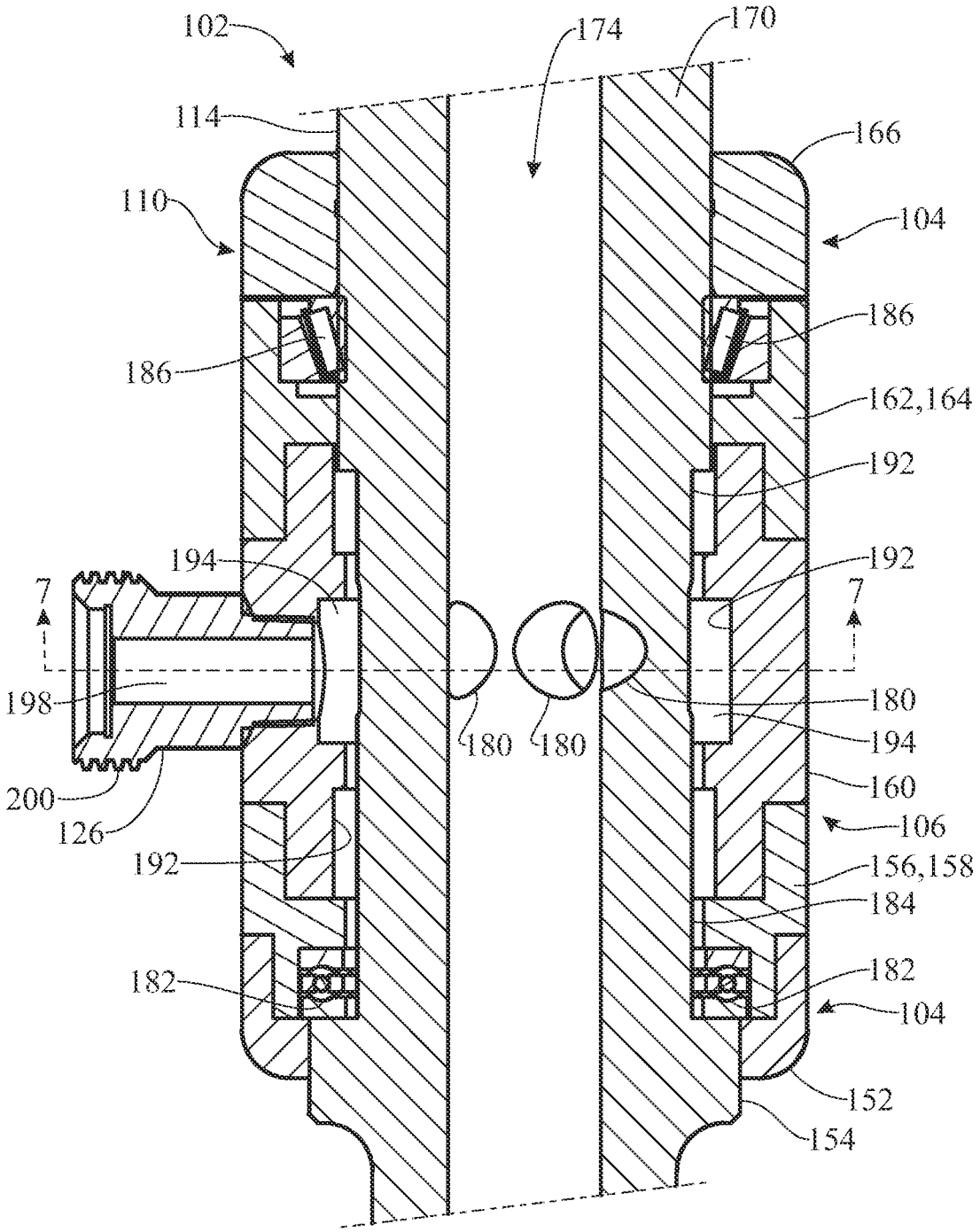
FIG. 6 presents an enlarged area of detail view of FIG. 5 illustrating a collar-shaped, outer swivel subassembly of the swivel assembly of FIG. 3 and a system for feeding cement into the swivel assembly.

Referring to FIGS. 5 and 6, as mentioned heretofore, the collar-shaped, outer swivel subassembly 110 is mounted on the swivel shaft 114 such that the outer swivel subassembly 110 and swivel shaft 114 may jointly reciprocate in the axial direction defined by the central longitudinal axis 115, while the swivel shaft 114 is rotatable relative to the cement inlet 126. For example, the upper and lower end caps 166 and 152, respectively, may be attached to the swivel shaft 114 such that the upper and lower end caps 166, 152 jointly rotate and reciprocate with the swivel shaft 144. For instance, in the present embodiment, the upper end cap 166 is threaded to the external threads 176 of the swivel shaft 114, and the lower end cap 152 is secured to the annular ledge 154 of the swivel shaft 114 such as by a threaded connection or welding. The upper and lower end caps 166 and 152 jointly form a non-rotatable, first subassembly 104 of the swivel assembly 102 which is configured to rotate and axially reciprocate with the swivel shaft 114. In turn, a rotatable, second subassembly 106 is formed by the bearing-retaining collars 156, 158, the cement-receiving central collar 160, and the sealing collars 162, 164, all of which are non-rotationally connected to one another and spaced-apart from the swivel shaft 114, as best shown in FIG. 6, such that the second subassembly 106 and the swivel shaft 114 are rotatable relative to one another about the central longitudinal axis 115, while the first subassembly 104 (located at top and bottom ends of the second subassembly 106) prevents the second subassembly 106 from axially moving relative to the swivel shaft 114.

As further shown in FIG. 5, the swivel assembly 102 may include a series of roller bearings 182 facilitating rotation of the second subassembly 106 relative to the swivel shaft 114. For example, the roller bearings 182 may be sandwiched between the swivel shaft 114 and at least one of the bearing-retaining collars 156, 158. The outer swivel subassembly 110 may further include a V-shaped or other rubber sealing member arranged between the first subassembly 104 and the swivel shaft 114 to prevent cement from exiting the outer swivel subassembly 110. For instance, the depicted embodiment includes at least one rubber sealing member 186 located between at least one of the sealing collars 162, 164 and the outer surface 184 of the swivel shaft 114. In other embodiments, alternative or additional sealing members (e.g., one or more O-ring sealing members) may be positioned in other spaces formed between the first subassembly 104 and the swivel shaft 114, if any.

Figure 7:
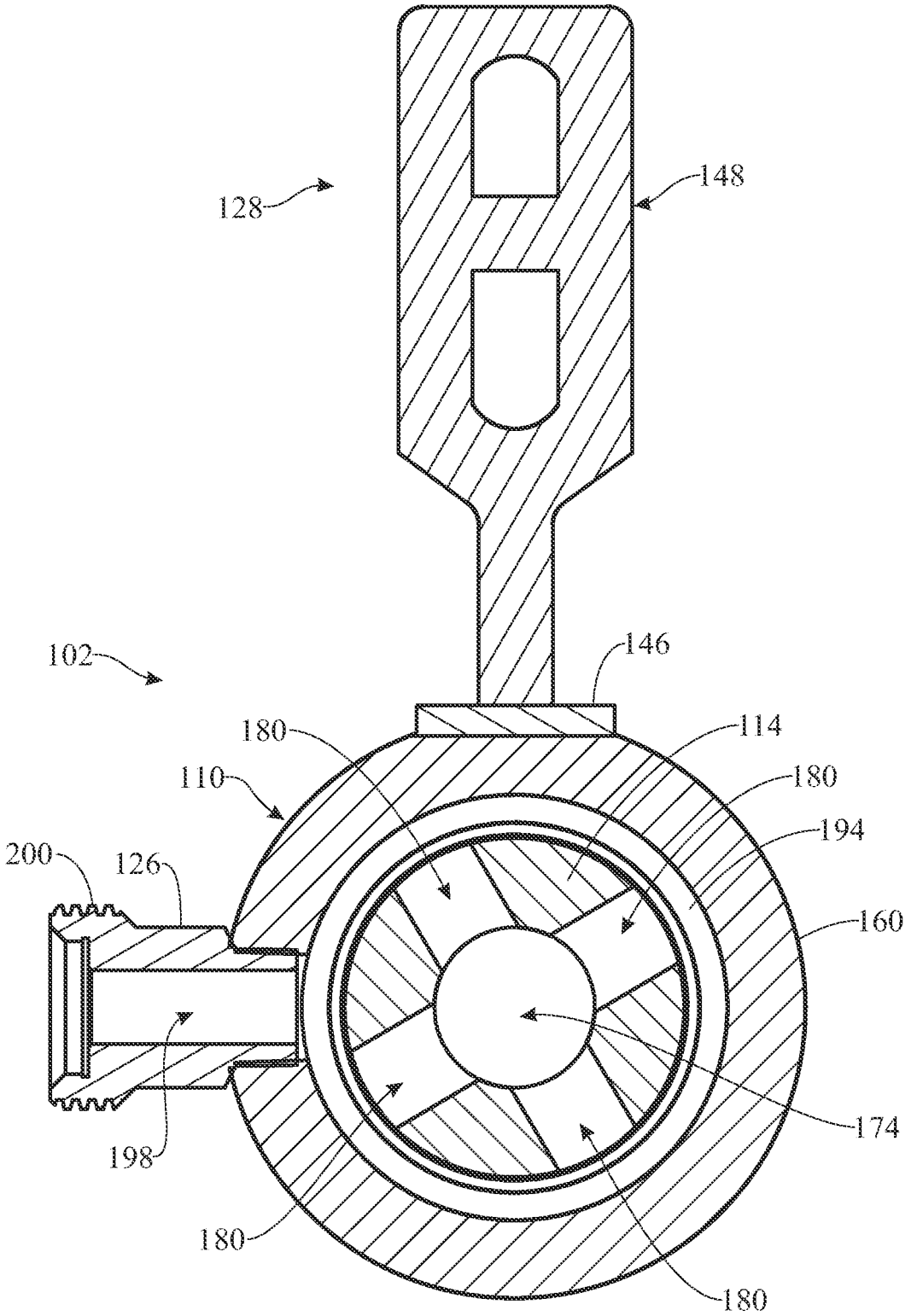
FIG. 7 presents a cross-sectional, bottom plan view of the swivel assembly, the cross section taken along section plan 7-7 indicated in FIG. 6.

Referring now to FIGS. 6 and 7, in order to feed cement through the cement inlet 126 to the through bore 174 of the swivel shaft 114, an annular space or gap 194 is formed between the inner surface 192 of the central collar 160 and the outer surface 184 of the swivel shaft 114. The annular gap 194 of the central collar 160 is in fluid communication with the windows 180 in the central shaft section 170 of the swivel shaft 114 and with the cement inlet 125, such that, as the swivel shaft 114 is rotating relative to the central collar 160 and cement inlet 126, cement injected into and through the cement inlet 126 may flow into the annular gap 194, then through the windows 180 in the swivel shaft 114, and into the through bore 174 of the swivel shaft 114 to flow downward through the through bore 174 and towards the plug launcher assembly 112. While not specifically shown, a valve, such as, but not limited to, a Kelly valve, may be connected to a top end 196 (FIG. 5) of the swivel shaft 114 to prevent the injected cement from flowing upward towards the drive shaft of the oil well. As shown, the cement inlet 126 is secured to the central collar 160, such as by a threaded connection, and has a bore 198 in fluid communication with the annular gap 194 formed in the inner surface 192 of the central collar 160. The cement inlet 126 may include external threads 200 for connection to an external source of cement or other substances intended to be injected through the disclosed oil well cementing head 100.

Figure 8:
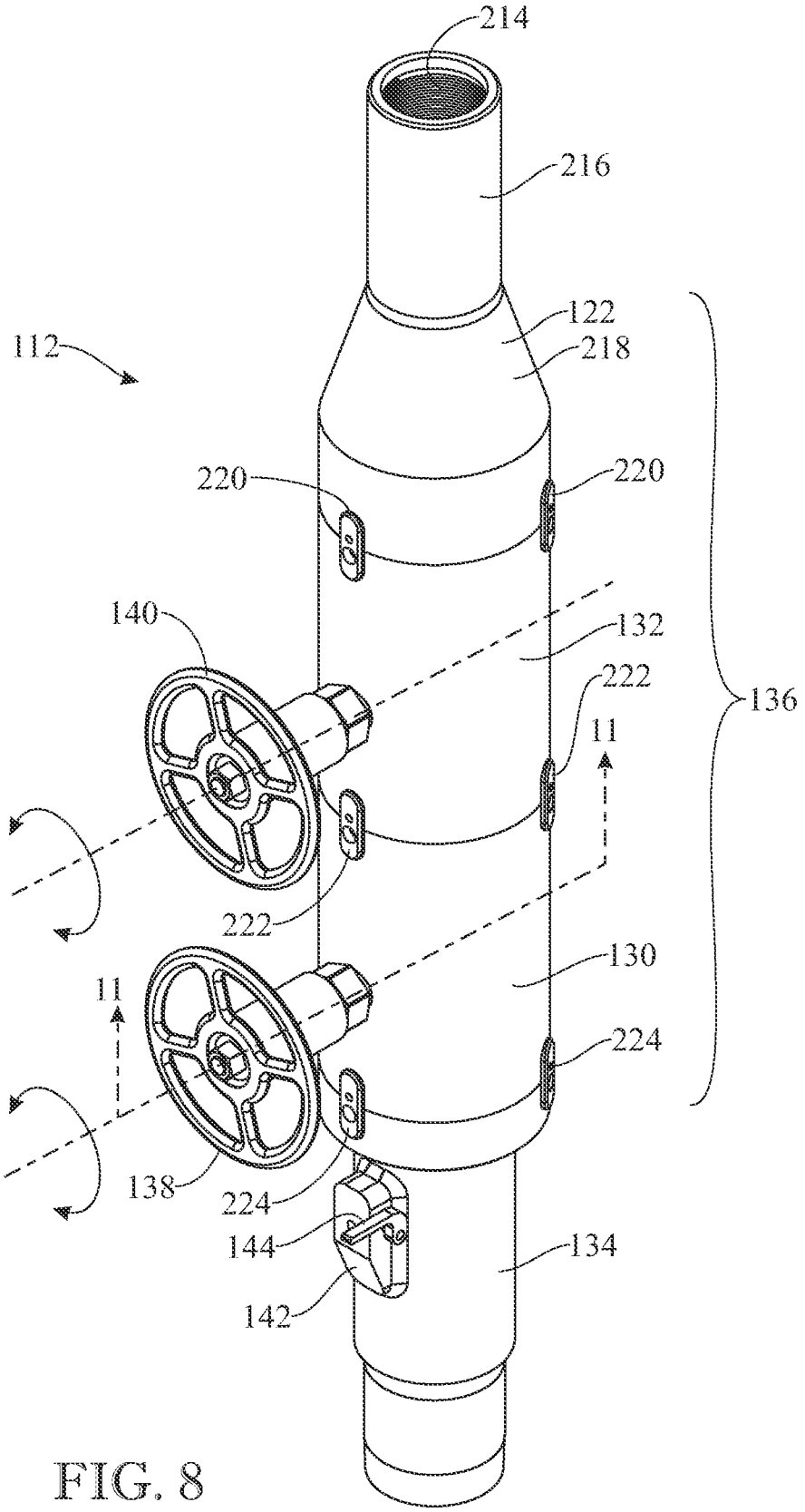
FIG. 8 presents an enlarged top, front isometric view of the plug launcher assembly of the oil well cementing head of FIG. 1.

Turning now to FIGS. 4, 5 and 8-12, and initially with regard to FIGS. 4, 5 and 8, as noted hereinabove, the swivel assembly 102 and the plug launcher assembly 112 of the disclosed oil well cementing head may be assembled and used together as a single unit. A bottom end 210 of the lower shaft section 172 of the swivel assembly 102 includes threads 212 (FIG. 4) which may cooperate with threads 214 (FIG. 8) located in an upper cylindrical section 216 of the top cap 122 of the plug launcher assembly 112. The top cap 122 of the plug launcher assembly 112 may include a lower conical portion 218 extending downwardly from the upper cylindrical section 216. The lower conical portion 218 may be connected to the one or more plug modules (e.g., the second plug module 132) of the plug launcher assembly 112 in a manner described below.

As noted hereinabove, the plug launcher assembly 112 may be formed as a modular unit capable of selectively accommodating one or more plug launching plug modules and corresponding plugs, as needed for a particular cementing job. In the disclosed embodiment, the plug launcher assembly 112 includes the top cap 122, the first plug module 130, the second plug module 132 and the bottom connector 134, which are threaded together during assembly and include the plurality of alignment wedges 136 to prevent relative rotation between said parts once they are assembled with the correct amount of torque and in proper alignment. With reference to FIG. 9, the plurality of alignment wedges 136 more specifically may include first alignment wedges 220 aligning the top cap 122 with the second plug module 132, second alignment wedges 222 aligning the second plug module 132 with the first plug module 130, and third alignment wedges 224 aligning the first plug module 130 with the bottom connector 134.

As shown in FIGS. 9 and 12, the top cap 122 is assembled to the second plug module 132 by the engagement of external threads 230 on an upper end 232 of the second plug module 132 with internal threads 234 located within the lower conical portion 218 of the top cap 122. Similarly, the second plug module 132 is assembled to the first plug module 130 by engagement of external threads 236 on an upper end 238 of the first plug module 130 with internal threads 240 located within a lower end 242 of the second plug module 132. Likewise, external threads 244 on an upper end 246 of the bottom connector 134 engage internal threads 248 in a lower end 250 of the first plug module 130 to connect the first plug module 130 to the bottom connector 134. It should be noted that a bottom end 252 of the bottom connector 134 is configured to engage the casing string of the oil well in known manner.

With continued reference to FIG. 9, in order to ensure perfect rotational alignment, and thus the correct torque, between the various components of the plug launcher assembly 112, each component includes recesses which are configured to align with corresponding recesses on the adjacent component, where each pair of corresponding recesses is shaped and sized to receive a respective wedge of the plurality of wedges 136 to secure the components in proper alignment. For example, the top cap 122 includes top cap recesses 260 which cooperate with corresponding, upper recesses 262 in the upper end 232 of the second plug module 132, wherein each top cap recess 260 and corresponding upper recess 262 receives a respective one of the first alignment wedges 220 to maintain the proper threaded alignment.

Figure 10:
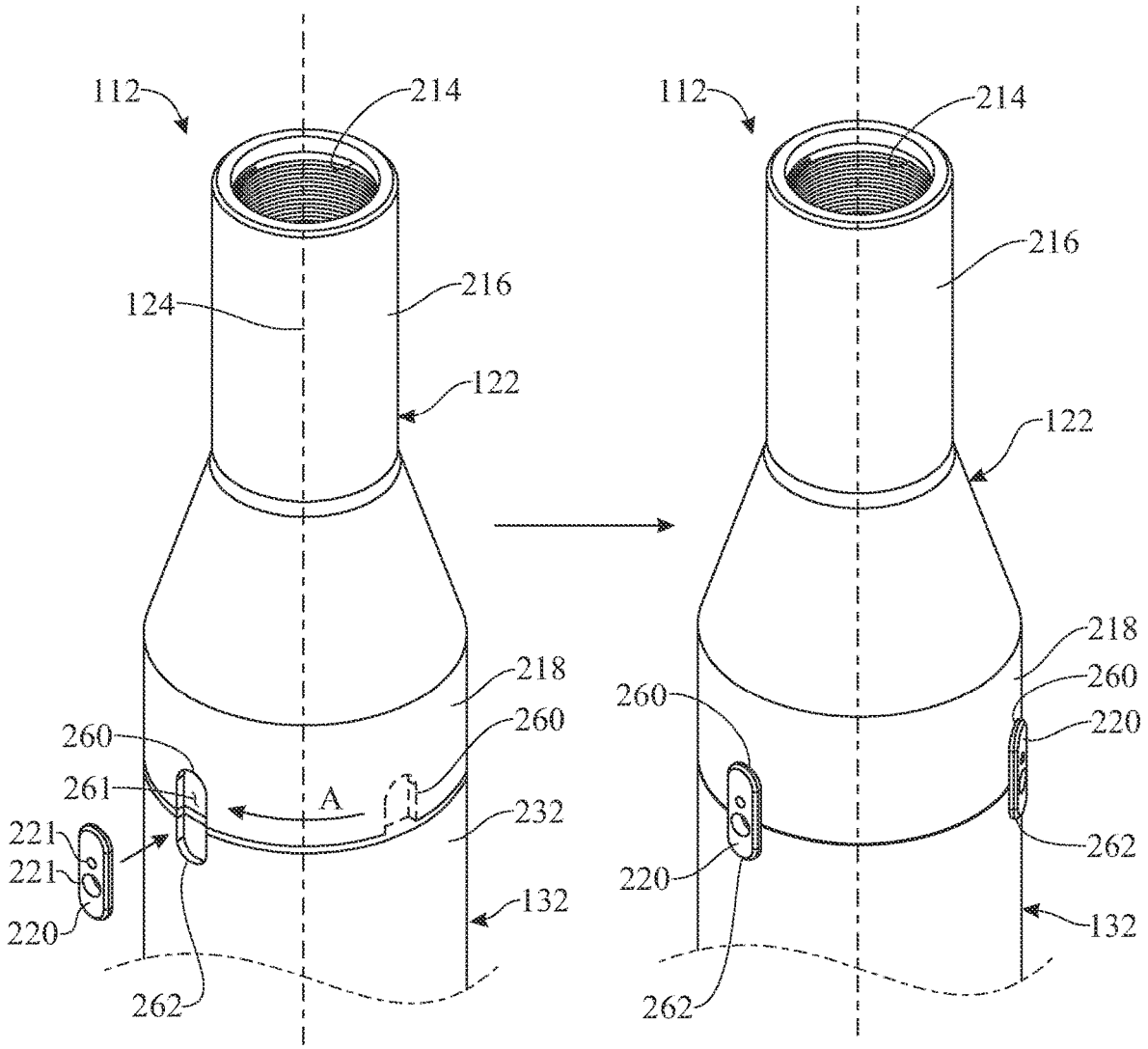
FIG. 10 presents an enlarged area of detail view of an alignment system for facilitating assembly of components of the plug launcher assembly of FIG. 8.

Referring to FIG. 10, during assembly, the top cap 122 is threaded onto the second plug module 132, in the manner described hereinabove, by rotating the top cap 122 in the direction of arrow "A" and about a central longitudinal axis 124 of the plug launcher assembly 112. The top cap 122 is rotated in the direction of arrow "A" until the top cap recesses 260 in the lower conical portion 218 of the top cap 122 align perfectly with the upper recesses 262 in the upper end 232 of the second plug module 132. The placement of the top cap recesses 260 and upper recesses 262 is "timed" to the threads 230, 234 (FIG. 9) of the second plug module 132 and the top cap 122 to ensure that, when the recesses 260, 262 are aligned, the top cap 122 and the second plug module 132 are threaded together without over- or under-threading of the components to one another, thereby preventing inadvertent separation due to inadequate threading or damage to the threads due to over-tightening, both conditions being costly in terms of equipment damage and time lost. Further, proper threading ensures the exact correct amount of torque or tightness between the top cap 122 and the second plug module 132.

With continued reference to FIG. 10, once the top cap recesses 260 in the top cap 122 and the upper recesses 262 in the second plug module 132 have been brought into alignment, the first alignment wedges 220 may be inserted into the aligned recesses 260, 262 to secure the alignment and maintain the alignment (and thus the relative rotational position of the top cap 122 and second plug module 132) as the entire oil well cementing head 102 is rotated by the drive assembly of the oil well. In some cases, the tolerances of the shapes of the disclosed recesses may be sufficiently tight or close requiring some urging of the first alignment wedges 220 to be seated in place within the recesses. These tight tolerances may ensure the above-mentioned proper threading and torque, and may further ensure that the first alignment wedges 220 do not fall or fly out of the recesses 260, 263 during operation. Alternatively or additionally, one or more fasteners (not shown) may secure the wedges 200 in place within the recesses 260, 263; for example, one or more high-tensile screws (not shown) may be fitted through one or more corresponding fastener holes 221 and secured to an inner wall or floor of the recesses 260, 263.

Returning to FIG. 9, it can be seen that the second plug module 132 includes lower recesses 264 in the lower end 242 of the second plug module 132 which cooperate with upper recesses 266 in the upper end 238 of the first plug module 130 to ensure proper threading and receive the second alignment wedges 222 to maintain the alignment. Similarly, the first plug module 130 includes lower recesses 268 in the lower end 250 of the first plug module 130 which cooperate with bottom connector recesses 270 formed in the upper end 246 of the bottom connector 134 also to ensure proper threading and receive the third alignment wedges 224 to maintain the alignment. It should be noted that the disclosed components are assembled in the same manner as was discussed above with regard to the top cap 122, the second plug module 132 and the first alignment wedges 220 in FIG. 10.

In some embodiments, the first plug module 130 and second plug module 132 may be configured to be interchangeably mounted, or to be mounted alone. For example, the external threads 236 and 230 of the first and second modules 130 and 132, respectively, may both be compatible for threading to the internal threads 234 of the lower conical portion 218 of the top cap 122, and the upper recesses 266 and 262 of the first and second modules 130 and 132, respectively, may both be configured to align with the top cap recesses 260 of the lower conical portion 218 of the top cap 122. Similarly, the internal threads 248 and 240 of the first and second modules 130 and 132, respectively, may both be compatible for threading to the internal threads 244 of the bottom connector 134, and the lower recesses 268 and 264 of the first and second modules 130 and 132, respectively, may both be configured to align with the bottom connector recesses 260 of the bottom connector 134. In dependence of the particular oil well application and requirements, the operators may select to assemble one, two or any number of plug modules.

Referring now to FIGS. 9-12, the disclosed plug launcher assembly 112 is provided to release plugs, such as, but not limited to, plugs 400 and 410, down the well casing, and also to allow for the flow of material, such as, mud, oil, the cement or cement slurry and the like through the oil well cementing head 100 without having to remove the plug launcher assembly 112. As will be described now in more detail, the plug modules, such as first and second plug modules 130 and 132 facilitate said dual functionality of the plug launcher assembly 112 of launching internal plugs into the oil well and allowing the passage of cement and other substances towards the oil well.

Figure 11:
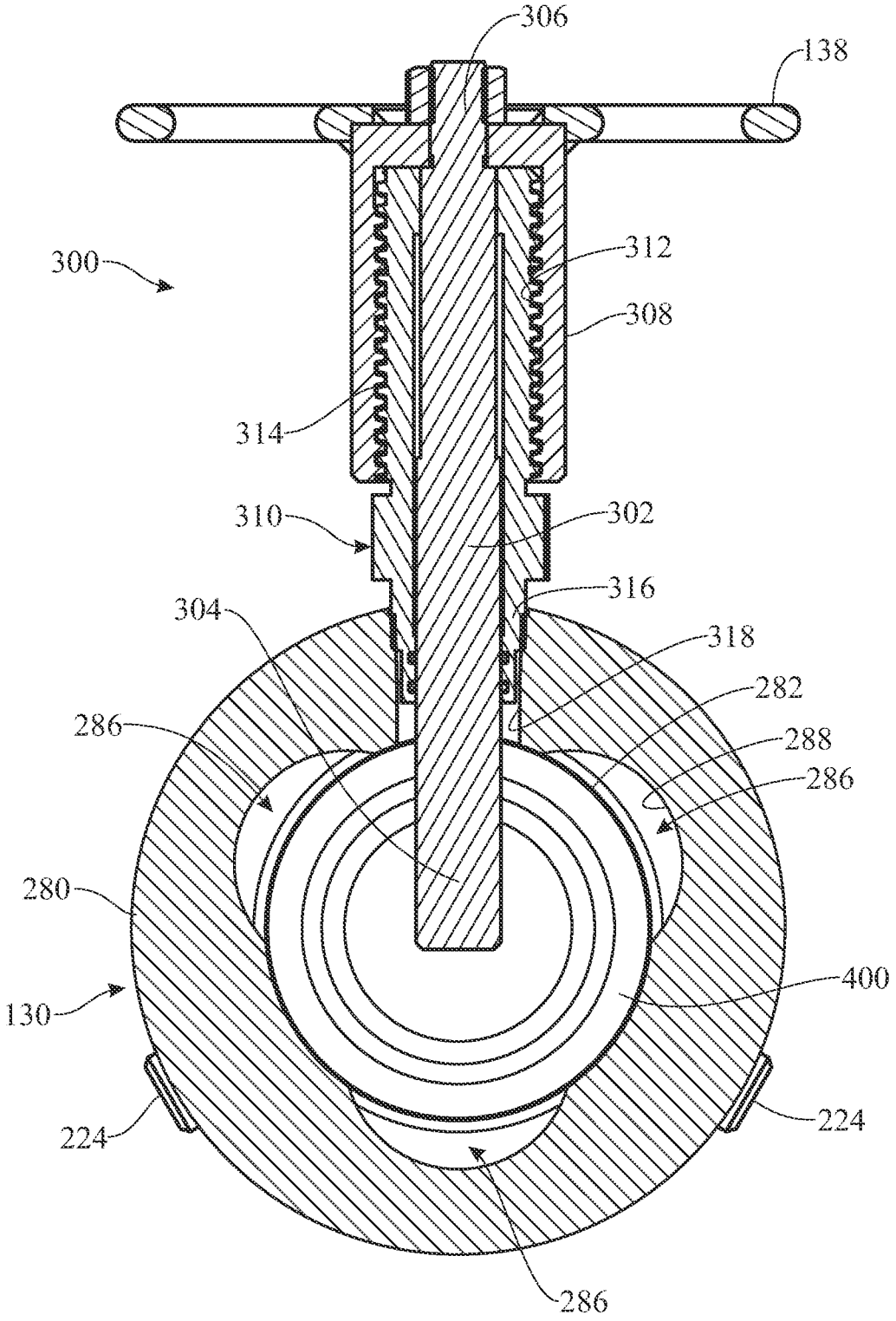
FIG. 11 presents a cross-sectional, bottom plan view of the plug launcher assembly of FIG. 8, the cross section taken along section plane 11-11 indicated in FIG. 8.

As shown in FIG. 9, the first plug module 130 includes an outer shell 280 and an inner sleeve 282 provided in a hollow bore 284 which extends longitudinally through the outer shell 280. The inner sleeve 282 houses the first plug 400 as described below, and rests against an inner surface 288 of the outer shell 280. The inner surface 288 of the first plug module 130 includes longitudinal channels 286 formed as recesses or grooves along the inner surface 288. As best shown in FIG. 11, the longitudinal channels 286 are enclosed by the inner surface 288 and the inner sleeve 282, and define a passageway arranged radially outward of the inner sleeve 282 (and thus of the first plug 400 housed within the inner sleeve 282) for the passage of material longitudinally through the first plug module 130.

Similarly, as further shown in FIG. 9, the second plug module 132 includes an outer shell 290 and an inner sleeve 292 provided in a hollow bore 294 which extends longitudinally through the outer shell 290. The inner sleeve 292 houses the second plug 410 as described below, and rests against an inner surface 298 of the outer shell 290. In identical manner to that described above, in order to pass material around the second plug 410, the second plug module 132 includes longitudinal channels 296 formed in the inner surface 298 of the outer shell 290, between—and laterally enclosed by—the inner surface 298 and the inner sleeve 292. The longitudinal channels 296 define a passageway arranged radially outward of the inner sleeve 292 and second plug 410 for the passage of material longitudinally through the second plug module 132.

When assembled, the longitudinal channels 286 of the first plug module 130 align with the longitudinal channels 296 of the second plug module 132, forming a continuous passageway around the first and second plugs 400, 410. It must be noted that the second alignment wedges 222 fitted into the aligned recesses 266 and 264 of the first and second plug modules 130 and 132, respectively, further contribute to correctly align the longitudinal channels 286 of the first plug module 130 with the longitudinal channels 296 of the second plug module 132. With the longitudinal channels 286 and 296 aligned, material entering the top cap 122 from the swivel assembly 102 passes into and through the aligned longitudinal channels 286 and 296, bypassing the first and second plugs 400 and 410, and out the bottom connector 134 and into the casing string for use in cementing the annular space around the casing string in the oil well. This novel arrangement, and particularly, the sleeve holding the plug, and the longitudinal channel being enclosed by internal walls and the sleeve, provides a plug launcher assembly 112 which may be manufactured and assembled at reasonable cost and is yet successful in holding one or more plugs and simultaneously allowing the passing of cement.

Turning now to FIGS. 9, 11 and 12, the first plug module 130 of the plug launcher assembly 112 includes a first release mechanism 300 for retaining and releasing the first plug 400 from within the first plug module 130. The first release mechanism 300 is carried by the outer shell 280 of the first plug module 130 and generally includes the first launching wheel 138 and a wheel shaft 302 connected to the first launching wheel 138. As best shown in the cross-sectional bottom plan view of FIG. 11 and the cross-sectional side elevation view of FIG. 12, the wheel shaft 302 initially extends under the first plug 400 to retain the first plug 400 within the first plug module 130 until the first plug 400 is released as described herein.

Specifically, in the initial position shown in FIG. 12, an inner portion 304 of the wheel shaft 302 extends into the outer shell 280 and under the first plug 400. An outer portion 306 of the wheel shaft 302 is fixedly mounted to a drive sleeve 308 which in turn is rotatably mounted on a drive shaft 310 affixed to the outer shell 290. Inner threads 312 in the drive sleeve 308 cooperate with outer threads 314 on the drive shaft 310 such that rotation of the first launching wheel 138 unthreads the drive sleeve 308 from the drive shaft 310 and draws the wheel shaft 302 outward of the outer shell 290. Sufficient rotation of the first launching wheel 138 eventually draws the inner portion 304 of the wheel shaft 302 out from under the first plug 400 to release the first plug 400 out of the plug launcher assembly 112 and down into the oil well casing string. A shell end 316 of the drive shaft 310 is secured within a side bore 318 formed through the outer shell 280 of the first plug module 130. The side bore 318 also provides the passageway for the movement of the wheel shaft 302 through the outer shell 280.

Similarly, with regard to FIGS. 9 and 12, the second plug module 132 of the plug launcher assembly 112 includes a second release mechanism 320 for retaining and releasing the second plug 410 out of the plug launcher assembly 112. The second release mechanism 320 is carried by the outer shell 290 of the second plug module 132 and generally includes the second launching wheel 140 and a wheel shaft 322 connected to the second launching wheel 140. The wheel shaft 322 initially extends under the second plug 410 to retain the second plug 410 within the second plug module 132 until the second plug 410 is released as described herein.

In the initial position of FIG. 12, an inner portion 324 of the wheel shaft 322 extends into the outer shell 290 and under the second plug 410. An outer portion 326 of the wheel shaft 322 is affixed to a drive sleeve 328 which is rotatably mounted on a drive shaft 330 affixed to the outer shell 290. Inner threads 332 in the drive sleeve 328 cooperate with outer threads 334 on the drive shaft 330 such that rotation of the second launching wheel 140 unthreads the drive sleeve 328 from the drive shaft 330 and draws the wheel shaft 322 outward of the outer shell 290. Sufficient rotation of the second launching wheel 140 eventually draws the inner portion 324 of the wheel shaft 322 out from under the second plug 410 to release the second plug 410 from the plug launcher assembly 112 and down into the oil well casing string. A shell end 336 of the drive shaft 330 is fixed within a side bore 338 formed through the other shell 290 of the second plug module 132. The side bore 338 provides the access through the outer shell 290 for movement of the wheel shaft 322.

In this manner, the first and second release mechanisms 300 and 320 retain the first and second plugs 400 and 410, respectively, within the plug launcher assembly 112 and permit controlled release of the first and second plugs 400 and 410 out of the plug launcher assembly 112.

With reference to FIGS. 1 and 12-15, an example of use and operation of the oil well cementing head 100 will now be described. In this example, two plug modules (i.e. the first and second plug modules 130 and 132) have been mounted, as the operators have considered that the oil well conditions will require the launching of two plugs. Accordingly, the first and second plugs 400 and 410 are positioned within the respective first and second plug modules 130 and 132 of the plug launcher assembly 112 and held in place by the first and second release mechanisms 300 and 320, respectively, as described hereinabove and shown in FIG. 12. Once the first and second plugs 400 and 410 have been loaded into the corresponding modules and the plug launcher assembly 112 has been assembled, the plug launcher assembly 112 is attached to the swivel assembly 102 to form the oil well cementing head 100 (FIG. 1). Thereafter, the bottom end 252 of the bottom connector 134 of the plug launcher assembly 112 is connected to the topmost casing (not shown) of the casing string, and the top end 116 of the swivel shaft 114 of the swivel assembly 102 is connected to a drive shaft or drive head of the oil well rig. The anchor 128 of the swivel assembly 102 is further connected to a cable or other external structure (not shown) to prevent rotation of the cement inlet 126 with the swivel shaft 114, as described hereinabove, and a source of cement or other external material is connected to the cement inlet 126 of the swivel assembly 102. The disclosed oil well cementing head 100 is thus assembled to the oil well rig and in a condition for use, shown in FIGS. 1 and 12.

The drive head is then operated to rotate and longitudinally reciprocate, jointly with the swivel shaft 114 and the plug launcher assembly 112 connected to the swivel shaft 114. The second subassembly 106 of the swivel assembly 102 is secured and prevented from rotation (but allowed to longitudinally oscillate) by the cable or other external structure connected to the anchor 128.

Starting from the initial condition of FIGS. 1 and 12, in a typical use, mud is passed through the oil well cementing head 100 and down into the casing string (not shown). Specifically, with reference to FIG. 5, the mud is passed through the cement inlet 126, through the windows 180 in the swivel shaft 114 and through the longitudinal bore 174 of the swivel shaft 114. As noted above, a valve, such as a Kelly valve, is provided to prevent material from flowing upward within the bore 174 beyond a certain distance and to enable the mud to flow predominantly downward along the bore 174 and out of the swivel shaft 114.

With continued reference to FIG. 12, as the mud flows down out of the swivel shaft 114, the mud enters the plug launcher assembly 112 and is engaged or blocked by the second plug 410 which is locked in place and prevented from movement by the wheel shaft 322 of the second release mechanism 320. This diverts the mud into the longitudinal channels 296 and 286 within the second and first plug modules 132 and 130, respectively, such that the mud travels along the longitudinal channels 296, 286, into an inner bore 350 of the bottom connector 134, and along the inner bore 350 for passage into the casing string. As is known, additional material such as oils, light nitrogen filled slurries and the like may be subsequently passed through the oil well cementing head 100 in similar manner. For example, the mud and/or or any of these materials may be fed into the oil well to initially flush the oil well prior to cementing.

Figure 13:
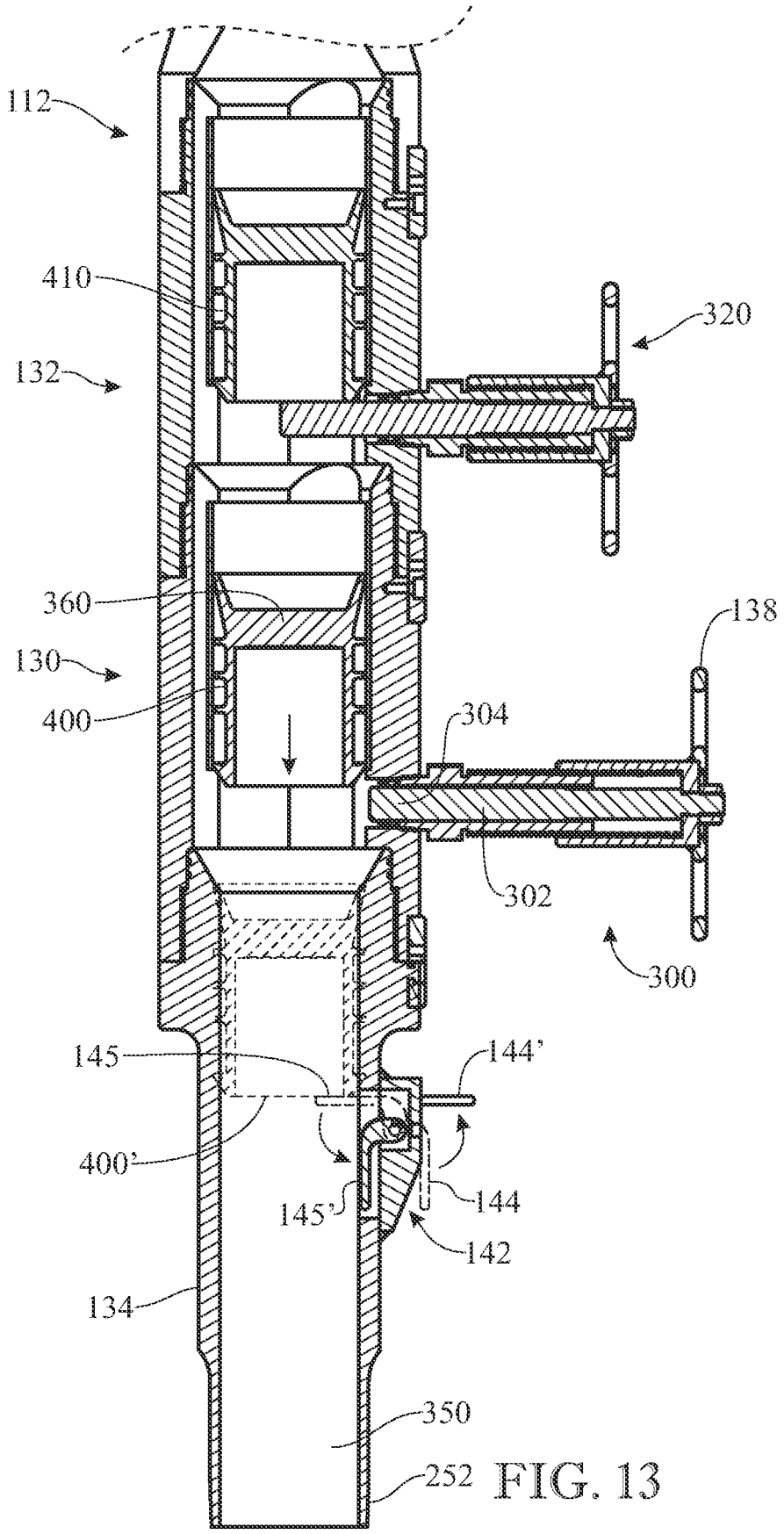
FIG. 13 presents a cross-sectional, side elevation view of the plug launcher assembly, similar to FIG. 12, illustrating the release of a first cementing plug from the plug launcher assembly.

Once the flushing process has been completed, the first plug 400 will next be released down into the casing string in order to wipe the inner surface of the casing string. Since the plug launcher assembly 112 is rotating and reciprocating with the swivel shaft 114, the drive head needs to be first stopped in its rotation and reciprocation for the workers to operate the first release mechanism 130 in order to release the first plug 400. Once the rotation and reciprocation has stopped, as shown in FIG. 13, the workers rotate the first launching wheel 138 to withdraw the inner portion 304 of the wheel shaft 302 out from under the first plug 400, thereby releasing the first plug 400 and allowing the first plug 400 to drop out of the plug launcher assembly 112 and down the casing string to clean the interior of the casing string. The first plug 400 will travel down the casing string until it engages and is blocked by valves at the bottom of the casing string. It should be noted that the first plug 400 may be provided with a breakable rear membrane 360.

With continued reference to FIG. 13, as the first plug 400 passes through the bottom connector 134 of the plug launcher assembly 112 (in which position the first plug is shown in phantom lines and indicated with reference numeral 400'), the inner segment 145 of the indicator 142, previously set across the bore 350 of the bottom connector 134, is engaged or tripped by the first plug 400', causing the indicator 142 to pivot as shown in the figure. Rotation of the indicator 142 causes the inner segment 145 to be pivoted to a downward position, indicated at 145', and the outer segment 144 to be pivoted to a raised position, indicated at 144'. Raising of the outer segment from an initial lowered position indicated at 144 to the elevated position indicated at 144' provides the workers with a positive visual indication confirming that the first plug 400 has been successfully released from the oil well cementing head 100 and down into the casing string. Having confirmed a successful dropping of the first plug 400, a worker may next manually "reset" the indicator 142 by pushing the outer segment from the raised position, indicated at 144', to the lowered position, indicated at 144, and thereby returning the inner segment to the inwardly-extended position, indicated at 145.

Figure 14:
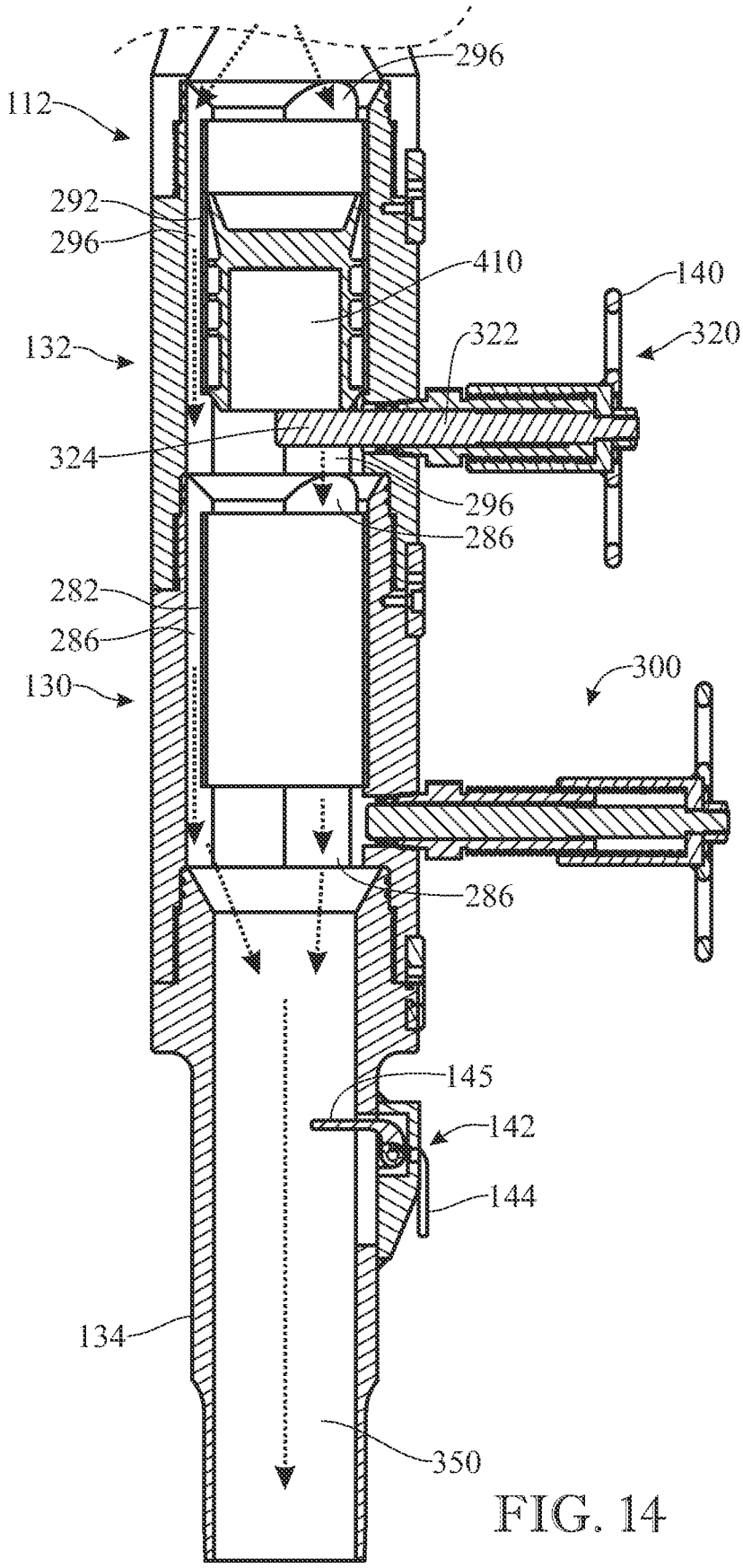
FIG. 14 presents a cross-sectional, side elevation view of the plug launcher assembly, similar to FIG. 13, illustrating flow of cement through the plug launcher assembly.

With reference now to FIG. 14, after the first plug 400 has been released, a source of cement is connected to the cement inlet 126, and the drive head is then once more activated to rotate and oscillate the swivel shaft 114. The cement flows though the oil well cementing head 100 through the longitudinal channels 296, 286 and the bore 350, as described above with reference to the mud and as shown in dotted arrow lines. It should be noted that the top, remaining plug (i.e. the second plug 410) serves the function of blocking the passing of cement through the second sleeve 292 and therefore contributes to directs the flow of cement to flow into the longitudinal channels 296 of the second plug module 132. Upon reaching the first plug 400 at the bottom of the casing string, the cement punctures or breaks the rear membrane 360 (FIG. 13) of the first plug 400 to allow the cement to flow out of the casing string and up through the annular gap around the casing string to seal the oil well. Cement is fed into the oil well cementing head 100 and injected into the oil well while the drive head and oil well cementing head 100 continue to rotate and oscillate the casing string.

Figure 15:
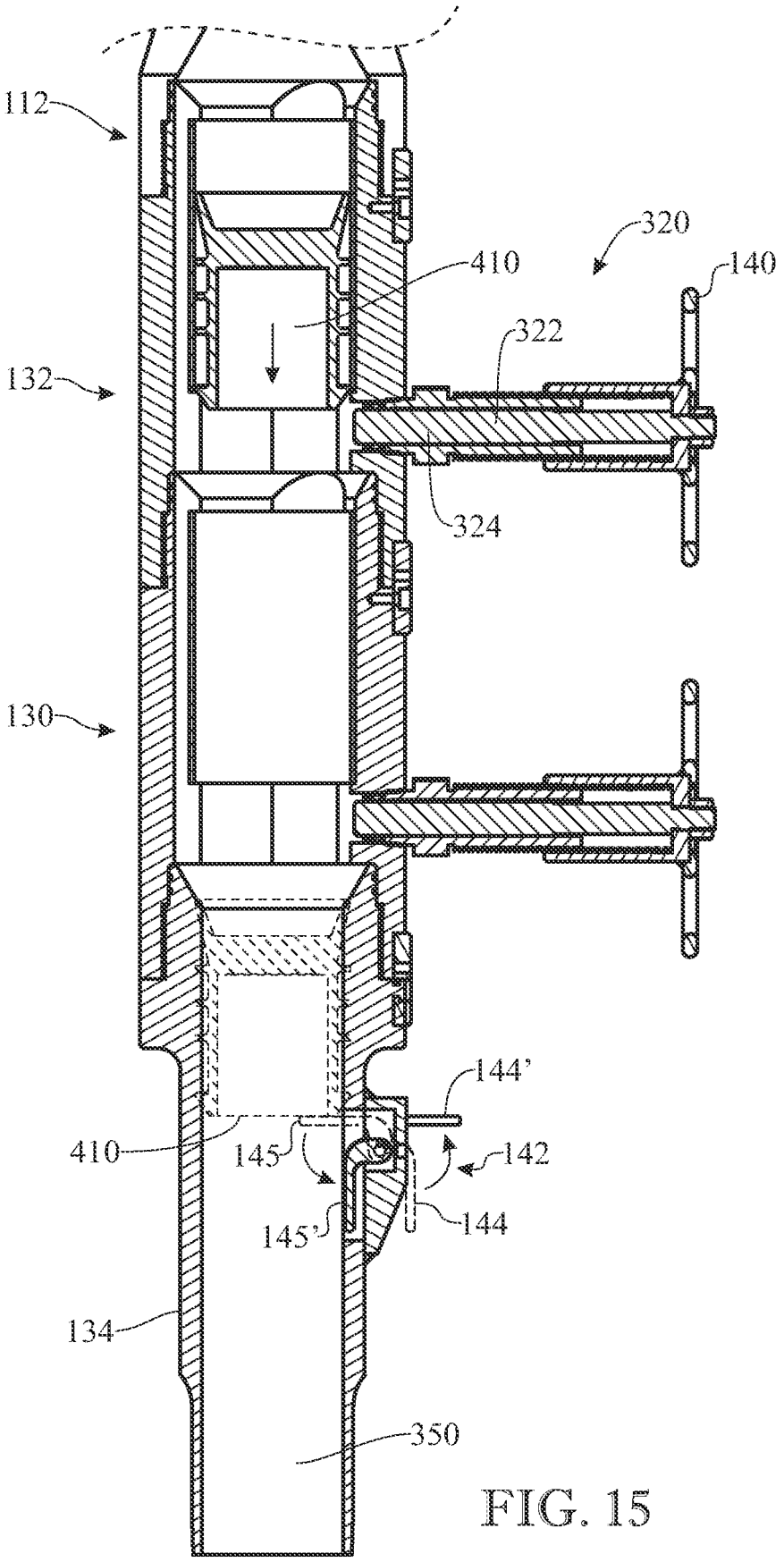
FIG. 15 presents a cross-sectional, side elevation view of the plug launcher assembly, similar to FIG. 14, illustrating the release of a second cementing plug from the plug launcher assembly.

Once the cementing process has been completed, the drive head is again stopped and, as shown in FIG. 15, the second plug 410 is released in similar manner rotating the second launching wheel 140 to draw the inner portion 324 of the wheel shaft 322 of the second release mechanism 320 out from under the second plug 410 and allow the second plug 410 to fall down the casing string in similar fashion until the second plug 410 engages the valves at the bottom of the casing string. The inner segment 145 of the indicator 142 is once more pushed by the passing second plug 410, causing the outer segment 144 of the indicator 142 to rise to the raised position indicated at 144' and thereby give the nearby workers a visual indication confirming that the second plug 410 has been successfully launched down the casing string. Unlike the first plug 400, the second plug 410 may not have a breakable rear membrane and may be configured to seal the casing string.

In this manner, the disclosed oil well cementing head 100 provides many novel and useful timesaving features in a combined swivel assembly 102 and plug launcher assembly 112 to facilitate cementing an oil well.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An oil well cementing head for insertion of material and two or more plugs into a casing string of an oil well, the oil well cementing head comprising:

a swivel assembly mountable between a drive head and a casing string, the swivel assembly comprising:

a swivel shaft formed along a longitudinal direction, the swivel shaft configured to be rotated about a central longitudinal axis thereof and longitudinally reciprocated by the drive head, the swivel shaft comprising an internal bore extending longitudinally along the swivel shaft and one or more windows formed through the swivel shaft in fluid communication with the internal bore, and an outer swivel subassembly carried by the swivel shaft and jointly movable with the swivel shaft in the longitudinal direction, the outer swivel subassembly arranged radially outward of and around the swivel shaft such that the swivel shaft extends through the outer swivel subassembly, the outer swivel subassembly comprising a rotatable subassembly including a material inlet, wherein the rotatable subassembly and swivel shaft are rotatable relative to one another about the central longitudinal axis such that the rotatable subassembly may remain rotationally fixed while the swivel shaft rotates relative to the central longitudinal axis, wherein the outer swivel subassembly and swivel shaft enclose an annular gap therebetween, wherein the annular gap faces the rotatable subassembly and material inlet and is in fluid communication with the material inlet and the windows of the swivel shaft in all rotational positions of the swivel shaft relative to the rotatable subassembly;

a plug launcher assembly affixed to and jointly rotatable and longitudinally movable with the swivel shaft of the swivel assembly, the plug launcher assembly releasably containing two or more plugs and providing fluid communication from the internal through bore of the swivel shaft to a bottom end of the plug launcher assembly, wherein the plug launcher assembly comprises two or more plug modules, wherein each plug module releasably houses a respective plug of the two or more plugs, and wherein each plug module is selectively mountable to the swivel shaft alone or in series with one or more remaining plug modules of the two or more plug modules to transfer a rotational and longitudinal movement of the swivel shaft towards a bottom end of the plug launcher assembly; and one or more alignment wedges disconnectably connectable between adjacent plug modules of the two or more plug modules and configured to prevent relative rotation between said adjacent plug modules.

2. The oil well cementing head of claim 1, wherein the outer swivel subassembly further comprises a non-rotatable subassembly arranged at opposite longitudinal ends of the rotatable subassembly, the non-rotatable subassembly fixedly attached to the swivel shaft for joint rotational and longitudinal movement with the swivel shaft, and further wherein the non-rotatable subassembly blocks longitudinal movement of the rotatable subassembly relative to the swivel shaft.

3. The oil well cementing head of claim 2, wherein the non-rotatable and rotatable subassemblies are mountable by successive stacking on the swivel shaft from a top end of the swivel shaft towards a bottom end of the swivel shaft.

4. The oil well cementing head of claim 1, further comprising an anchor affixed to the rotatable subassembly of the outer swivel subassembly, the anchor providing a connection point to secure the rotatable subassembly against rotation with the swivel shaft.

5. The oil well cementing head of claim 4, wherein the anchor extends radially outward of the rotatable subassembly.

6. The oil well cementing head of claim 1, wherein the plug launcher assembly comprises a top cap configured to jointly rotate and longitudinally move with a bottom end of the swivel shaft and a bottom cap configured to jointly rotate and longitudinally move with an oil well casing string, and further wherein the two or more plug modules are each selectively connectable alone or in series with one or more remaining plug modules of the two or more plug modules between the top and bottom caps to transfer rotational and longitudinal movement of the top cap to the bottom cap.

7. The oil well cementing head of claim 6, wherein the two or more plug modules are connectable in series with said one or more remaining plug modules in a longitudinally interchangeable manner.

8. The oil well cementing head of claim 6, further comprising one or more alignment wedges disconnectably connectable between the top cap and an adjacent plug module of the two or more plug modules and configured to prevent relative rotation between the top cap and the adjacent plug module.

9. The oil well cementing head of claim 6, further comprising one or more alignment wedges disconnectably connectable between the bottom cap and an adjacent plug module of the two or more plug modules and configured to prevent relative rotation between the bottom cap and the adjacent plug module.

10. The oil well cementing head of claim 1, wherein at least one of the two or more plug modules comprises a launching wheel arranged outside the plug module and a wheel shaft connected to the launching wheel, wherein the wheel shaft extends into the plug module and is movable by operating the launching wheel from an initial position in which the wheel shaft supports the respective plug inside the plug module to an extracted position in which the wheel shaft does not support the respective plug and the respective plug is free to fall through the plug module.

11. The oil well cementing head of claim 1, wherein each plug module of the two or more plug modules comprises a longitudinal through bore defined by an inner surface of said each plug module, with one or more channels formed radially outward in said inner surface, wherein each plug module further comprises an inner sleeve arranged inside the through bore and sealing against the inner surface to enclose the one or more channels, wherein the respective plug is received inside the inner sleeve, and further wherein the two or more plug modules are mountable in series such that the one or more channels of each plug module of the two or more plug modules are in fluid communication with the one or more channels of the remaining plug modules of the two or more plug modules.

12. The oil well cementing head of claim 11, wherein the one or more channels of a topmost plug module of the two or more plug modules are in fluid communication with the internal bore of the swivel shaft.

13. The oil well cementing head of claim 11, wherein the one or more channels of a bottommost plug module of the two or more plug modules are in fluid communication with a bottom end of the plug launcher subassembly.

14. The oil well cementing head of claim 1, wherein the plug launcher assembly comprises a pivotable indicator having jointly-pivotable outer and inner segments, the indicator configured to pivotably adopt an inactive position in which the inner segment extends into the plug launcher assembly to interfere with a downward passing therethrough of a plug and the outer segment is arranged in a lowered position, and an active position in which the inner segment is pivoted downward allowing a plug to pass and the outer segment is pivoted to a visible, raised position.

15. The oil well cementing head of claim 14, wherein the pivotable indicator is pivotable from the active position to the inactive position by manually pivoting the outer segment.

16. An oil well cementing head for insertion of material and two or more plugs into a casing string of an oil well, the oil well cementing head comprising:

a swivel assembly mountable between a drive head and a casing string, the swivel assembly comprising:

a swivel shaft formed along a longitudinal direction, the swivel shaft configured to be rotated about a central longitudinal axis thereof and longitudinally reciprocated by the drive head, the swivel shaft comprising an internal bore extending longitudinally along the swivel shaft and one or more windows formed through the swivel shaft in fluid communication with the internal bore, and an outer swivel subassembly carried by the swivel shaft and jointly movable with the swivel shaft in the longitudinal direction, the outer swivel subassembly arranged radially outward of and around the swivel shaft such that the swivel shaft extends through the outer swivel subassembly, the outer swivel subassembly comprising a rotatable subassembly including a material inlet, wherein the rotatable subassembly and swivel shaft are rotatable relative to one another about the central longitudinal axis such that the rotatable subassembly may remain rotationally fixed while the swivel shaft rotates relative to the central longitudinal axis, wherein the outer swivel subassembly and swivel shaft enclose an annular gap therebetween, wherein the annular gap faces the rotatable subassembly and material inlet and is in fluid communication with the material inlet and the windows of the swivel shaft in all rotational positions of the swivel shaft relative to the rotatable subassembly; and a plug launcher assembly affixed to and jointly rotatable and longitudinally movable with the swivel shaft of the swivel assembly, the plug launcher assembly releasably containing two or more plugs and providing fluid communication from the internal through bore of the swivel shaft to a bottom end of the plug launcher assembly, wherein the plug launcher assembly comprises two or more plug modules, wherein each plug module releasably houses a respective plug of the two or more plugs, and wherein each plug module is selectively mountable to the swivel shaft alone or in series with one or more remaining plug modules of the two or more plug modules to transfer a rotational and longitudinal movement of the swivel shaft towards a bottom end of the plug launcher assembly, and further wherein the plug launcher assembly comprises a top cap configured to jointly rotate and longitudinally move with a bottom end of the swivel shaft and a bottom cap configured to jointly rotate and longitudinally move with an oil well casing string, and further wherein the two or more plug modules are each selectively connectable alone or in series with one or more remaining plug modules of the two or more plug modules between the top and bottom caps to transfer rotational and longitudinal movement of the top cap to the bottom cap.

17. The oil well cementing head of claim 16, wherein the two or more plug modules are connectable in series with said one or more remaining plug modules in a longitudinally interchangeable manner.

18. The oil well cementing head of claim 16, further comprising one or more alignment wedges disconnectably connectable between the top cap and an adjacent plug module of the two or more plug modules and configured to prevent relative rotation between the top cap and the adjacent plug module.

19. The oil well cementing head of claim 16, further comprising one or more alignment wedges disconnectably connectable between the bottom cap and an adjacent plug module of the two or more plug modules and configured to prevent relative rotation between the bottom cap and the adjacent plug module.

20. An oil well cementing head for insertion of material and two or more plugs into a casing string of an oil well, the oil well cementing head comprising:

a swivel assembly mountable between a drive head and a casing string, the swivel assembly comprising:

a swivel shaft formed along a longitudinal direction, the swivel shaft configured to be rotated about a central longitudinal axis thereof and longitudinally reciprocated by the drive head, the swivel shaft comprising an internal bore extending longitudinally along the swivel shaft and one or more windows formed through the swivel shaft in fluid communication with the internal bore, and an outer swivel subassembly carried by the swivel shaft and jointly movable with the swivel shaft in the longitudinal direction, the outer swivel subassembly arranged radially outward of and around the swivel shaft such that the swivel shaft extends through the outer swivel subassembly, the outer swivel subassembly comprising a rotatable subassembly including a material inlet, wherein the rotatable subassembly and swivel shaft are rotatable relative to one another about the central longitudinal axis such that the rotatable subassembly may remain rotationally fixed while the swivel shaft rotates relative to the central longitudinal axis, wherein the outer swivel subassembly and swivel shaft enclose an annular gap therebetween, wherein the annular gap faces the rotatable subassembly and material inlet and is in fluid communication with the material inlet and the windows of the swivel shaft in all rotational positions of the swivel shaft relative to the rotatable subassembly; and a plug launcher assembly affixed to and jointly rotatable and longitudinally movable with the swivel shaft of the swivel assembly, the plug launcher assembly releasably containing two or more plugs and providing fluid communication from the internal through bore of the swivel shaft to a bottom end of the plug launcher assembly, wherein the plug launcher assembly comprises two or more plug modules, wherein each plug module releasably houses a respective plug of the two or more plugs, and wherein each plug module is selectively mountable to the swivel shaft alone or in series with one or more remaining plug modules of the two or more plug modules to transfer a rotational and longitudinal movement of the swivel shaft towards a bottom end of the plug launcher assembly; wherein each plug module of the two or more plug modules comprises a longitudinal through bore defined by an inner surface of said each plug module, with one or more channels formed radially outward in said inner surface, wherein each plug module further comprises an inner sleeve arranged inside the through bore and sealing against the inner surface to enclose the one or more channels, wherein the respective plug is received inside the inner sleeve, and further wherein the two or more plug modules are mountable in series such that the one or more channels of each plug module of the two or more plug modules are in fluid communication with the one or more channels of the remaining plug modules of the two or more plug modules.

21. The oil well cementing head of claim 20, wherein the one or more channels of a topmost plug module of the two or more plug modules are in fluid communication with the internal bore of the swivel shaft.

22. The oil well cementing head of claim 20, wherein the one or more channels of a bottommost plug module of the two or more plug modules are in fluid communication with a bottom end of the plug launcher subassembly.

23. An oil well cementing head for insertion of material and one or more plugs into a casing string of an oil well, the oil well cementing head comprising:

a swivel assembly mountable between a drive head and a casing string, the swivel assembly comprising:

a swivel shaft formed along a longitudinal direction, the swivel shaft configured to be rotated about a central longitudinal axis thereof and longitudinally reciprocated by the drive head, the swivel shaft comprising an internal bore extending longitudinally along the swivel shaft and one or more windows formed through the swivel shaft in fluid communication with the internal bore, and an outer swivel subassembly carried by the swivel shaft and jointly movable with the swivel shaft in the longitudinal direction, the outer swivel subassembly arranged radially outward of and around the swivel shaft such that the swivel shaft extends through the outer swivel subassembly, the outer swivel subassembly comprising a rotatable subassembly including a material inlet, wherein the rotatable subassembly and swivel shaft are rotatable relative to one another about the central longitudinal axis such that the rotatable subassembly may remain rotationally fixed while the swivel shaft rotates relative to the central longitudinal axis, wherein the outer swivel subassembly and swivel shaft enclose an annular gap therebetween, wherein the annular gap faces the rotatable subassembly and material inlet and is in fluid communication with the material inlet and the windows of the swivel shaft in all rotational positions of the swivel shaft relative to the rotatable subassembly; and a plug launcher assembly affixed to and jointly rotatable and longitudinally movable with the swivel shaft of the swivel assembly, the plug launcher assembly releasably containing at least one oil well cementing plug and providing fluid communication from the internal through bore of the swivel shaft to a bottom end of the plug launcher assembly; wherein the plug launcher assembly comprises a pivotable indicator having jointly-pivotable outer and inner segments, the indicator configured to pivotably adopt an inactive position in which the inner segment extends into the plug launcher assembly to interfere with a downward passing therethrough of a plug and the outer segment is arranged in a lowered position, and an active position in which the inner segment is pivoted downward allowing a plug to pass and the outer segment is pivoted to a visible, raised position.

24. The oil well cementing head of claim 23, wherein the pivotable indicator is pivotable from the active position to the inactive position by manually pivoting the outer segment.

* * * * *